US008870548B2

(12) United States Patent
Cedrone et al.

(10) Patent No.: US 8,870,548 B2
(45) **Date of Patent: *Oct. 28, 2014**

(54) SYSTEM AND METHOD FOR PRESSURE COMPENSATION IN A PUMP

(75) Inventors: James Cedrone, Braintree, MA (US); George L. Gonnella, Pepperell, MA (US)

(73) Assignee: Entegris, Inc., Billerica, MA (US)

( * ) Notice: Subject to any disclaimer, the term of this patent is extended or adjusted under 35 U.S.C. 154(b) by 287 days.

This patent is subject to a terminal disclaimer.

(21) Appl. No.: 13/251,976

(22) Filed: Oct. 3, 2011

(65) Prior Publication Data

US 2012/0070311 A1 Mar. 22, 2012

Related U.S. Application Data

(63) Continuation of application No. 11/602,508, filed on Nov. 20, 2006, now Pat. No. 8,029,247.

(60) Provisional application No. 60/741,682, filed on Dec. 2, 2005.

(51) Int. Cl.
*F04B 13/00* (2006.01)
*F04B 49/06* (2006.01)
*F04B 51/00* (2006.01)

(52) U.S. Cl.
CPC ..... *F04B 13/00* (2013.01); *F04B 49/065* (2013.01); *F04B 2205/03* (2013.01); *F04B 51/00* (2013.01)
USPC ..... 417/26; 417/212; 417/274; 222/63

(58) Field of Classification Search
CPC ..... F04B 13/00; F04B 2201/0201; F04B 2201/0601; F04B 2205/03
USPC ..... 417/26, 53, 212, 274; 222/61, 63; 210/767
See application file for complete search history.

(56) References Cited

U.S. PATENT DOCUMENTS 269,626 A 12/1882 Bodel et al.
826,018 A 7/1906 Concoff
(Continued)

FOREIGN PATENT DOCUMENTS

AU B-78872/87 4/1988
CA 1 271 140 7/1990
(Continued)

OTHER PUBLICATIONS

Final Rejection for Japanese Patent Application No. 2007-543342, Japanese Patent Office, mailed Feb. 21, 2012, 8 pgs. (with English translation).

(Continued)

*Primary Examiner* — Charles Freay
*Assistant Examiner* — Patrick Hamo
(74) *Attorney, Agent, or Firm* — Sprinkle IP Law Group

(57) ABSTRACT

Systems and methods for maintaining substantially a baseline pressure in a chamber of a pumping apparatus are disclosed. Embodiments of the present invention may serve to control a motor to compensate or account for a pressure drift which may occur in a chamber of the pumping apparatus. More specifically, a dispense motor may be controlled to substantially maintain a baseline pressure in the dispense chamber before a dispense based on a pressure sensed in the dispense chamber. In one embodiment, before a dispense is initiated a control loop may be utilized such that it is repeatedly determined if the pressure in the dispense chamber is above a desired pressure and, if so, the movement of the pumping means regulated to maintain substantially the desired pressure in the dispense chamber until a dispense of fluid is initiated.

7 Claims, 17 Drawing Sheets

(56) References Cited

U.S. PATENT DOCUMENTS

| | | | |
|---|---|---|---|
| 1,664,125 | A | 3/1928 | Lowrey |
| 2,153,664 | A | 4/1939 | Freedlander |
| 2,215,505 | A | 9/1940 | Hollander |
| 2,328,468 | A | 8/1943 | Laffly |
| 2,457,384 | A | 12/1948 | Krenz |
| 2,631,538 | A | 3/1953 | Johnson |
| 2,673,522 | A | 3/1954 | Dickey |
| 2,757,966 | A | 8/1956 | Samiran |
| 3,072,058 | A | 1/1963 | Christopher et al. |
| 3,227,279 | A | 1/1966 | Bockelman |
| 3,250,225 | A | 5/1966 | Taplin |
| 3,327,635 | A | 6/1967 | Sachnik |
| 3,623,661 | A | 11/1971 | Wagner |
| 3,741,298 | A | 6/1973 | Canton |
| 3,895,748 | A | 7/1975 | Klingenberg |
| 3,954,352 | A | 5/1976 | Sakai |
| 3,977,255 | A | 8/1976 | Groleau et al. |
| 4,023,592 | A | 5/1977 | Patzke |
| 4,093,403 | A | 6/1978 | Schrimpf |
| 4,452,265 | A | 6/1984 | Lonnebring |
| 4,483,665 | A | 11/1984 | Hauser |
| 4,541,455 | A | 9/1985 | Hauser |
| 4,597,719 | A | 7/1986 | Tano |
| 4,597,721 | A | 7/1986 | Santefort |
| 4,601,409 | A | 7/1986 | DiRegolo |
| 4,614,438 | A | 9/1986 | Kobayashi |
| 4,671,545 | A | 6/1987 | Miyazaki |
| 4,690,621 | A | 9/1987 | Swain |
| 4,705,461 | A | 11/1987 | Clements |
| 4,797,834 | A | 1/1989 | Honganen et al. |
| 4,808,077 | A | 2/1989 | Kan et al. |
| 4,810,168 | A | 3/1989 | Nogami et al. |
| 4,821,997 | A | 4/1989 | Zdeblick |
| 4,824,073 | A | 4/1989 | Zdeblick |
| 4,865,525 | A | 9/1989 | Kern |
| 4,913,624 | A | 4/1990 | Seki et al. |
| 4,915,126 | A | 4/1990 | Gyllinder |
| 4,943,032 | A | 7/1990 | Zdeblick |
| 4,950,134 | A | 8/1990 | Bailey et al. |
| 4,952,386 | A | 8/1990 | Davison |
| 4,966,646 | A | 10/1990 | Zdeblick |
| 5,061,156 | A | 10/1991 | Kuehne |
| 5,061,574 | A | 10/1991 | Henager, Jr. |
| 5,062,770 | A | 11/1991 | Story |
| 5,134,962 | A | 8/1992 | Amada |
| 5,135,031 | A | 8/1992 | Burgess |
| 5,167,837 | A | 12/1992 | Snodgrass |
| 5,192,198 | A | 3/1993 | Gebauer |
| 5,230,445 | A | 7/1993 | Rusnak |
| 5,261,442 | A | 11/1993 | Kingsford |
| 5,262,068 | A | 11/1993 | Bowers |
| 5,312,233 | A | 5/1994 | Tanny et al. |
| 5,316,181 | A | 5/1994 | Burch |
| 5,318,413 | A | 6/1994 | Bertoncini |
| 5,336,884 | A | 8/1994 | Khoshnevisan et al. |
| 5,344,195 | A | 9/1994 | Parimore, Jr. et al. |
| 5,350,200 | A | 9/1994 | Peterson et al. |
| 5,380,019 | A | 1/1995 | Hillery |
| 5,434,774 | A | 7/1995 | Seberger |
| 5,476,004 | A | 12/1995 | Kingsford |
| 5,490,765 | A | 2/1996 | Bailey |
| 5,511,797 | A | 4/1996 | Nikirk |
| 5,516,429 | A | 5/1996 | Snodgrass |
| 5,527,161 | A | 6/1996 | Bailey |
| 5,546,009 | A | 8/1996 | Raphael |
| 5,575,311 | A | 11/1996 | Kingsford |
| 5,580,103 | A | 12/1996 | Hall |
| 5,599,100 | A | 2/1997 | Jackson et al. |
| 5,599,394 | A | 2/1997 | Yabe |
| 5,645,301 | A | 7/1997 | Kingsford |
| 5,652,391 | A | 7/1997 | Kingsford |
| 5,653,251 | A | 8/1997 | Handler |
| 5,743,293 | A | 4/1998 | Kelly |
| 5,762,795 | A | 6/1998 | Bailey |
| 5,772,899 | A | 6/1998 | Snodgrass |
| 5,784,573 | A | 7/1998 | Szczepanek et al. |
| 5,785,508 | A | 7/1998 | Bolt |
| 5,793,754 | A | 8/1998 | Houldsworth et al. |
| 5,839,828 | A | 11/1998 | Glanville |
| 5,846,056 | A | 12/1998 | Dhindsa et al. |
| 5,848,605 | A | 12/1998 | Bailey |
| RE36,178 | E | 4/1999 | Freudinger et al. |
| 5,947,702 | A | 9/1999 | Biederstadt |
| 5,971,723 | A | 10/1999 | Bolt |
| 5,991,279 | A | 11/1999 | Haugli et al. |
| 6,033,302 | A | 3/2000 | Ahmed et al. |
| 6,045,331 | A | 4/2000 | Gehm et al. |
| 6,105,829 | A | 8/2000 | Snodgrass |
| 6,190,565 | B1 | 2/2001 | Bailey |
| 6,203,759 | B1 | 3/2001 | Pelc et al. |
| 6,210,745 | B1 | 4/2001 | Gaughan et al. |
| 6,238,576 | B1 | 5/2001 | Yajima |
| 6,250,502 | B1 | 6/2001 | Cote |
| 6,251,293 | B1 | 6/2001 | Snodgrass |
| 6,298,941 | B1 | 10/2001 | Spadafora |
| 6,302,660 | B1 | 10/2001 | Kurita |
| 6,318,971 | B1 | 11/2001 | Ota |
| 6,319,317 | B1 | 11/2001 | Takamori |
| 6,325,032 | B1 | 12/2001 | Sekiya et al. |
| 6,325,932 | B1 | 12/2001 | Gibson |
| 6,330,517 | B1 | 12/2001 | Dobrowskli |
| 6,348,098 | B1 | 2/2002 | McLoughlin et al. |
| 6,348,124 | B1 | 2/2002 | Garbett |
| 6,474,949 | B1 | 11/2002 | Arai et al. |
| 6,474,950 | B1 | 11/2002 | Waldo |
| 6,478,547 | B1 | 11/2002 | Savard |
| 6,497,817 | B1 | 12/2002 | Liang |
| 6,506,030 | B1 | 1/2003 | Kottke |
| 6,520,519 | B2 | 2/2003 | Howard |
| 6,540,265 | B2 | 4/2003 | Turk |
| 6,554,579 | B2 | 4/2003 | Martin |
| 6,575,264 | B2 | 6/2003 | Spadafora |
| 6,592,825 | B2 | 7/2003 | Pelc |
| 6,635,183 | B2 | 10/2003 | Gibson |
| 6,722,530 | B1 | 4/2004 | King et al. |
| 6,729,501 | B2 | 5/2004 | Peterson |
| 6,742,992 | B2 | 6/2004 | Davis |
| 6,742,993 | B2 | 6/2004 | Savard |
| 6,766,810 | B1 | 7/2004 | Van Cleemput |
| 6,767,877 | B2 | 7/2004 | Kuo |
| 6,837,484 | B2 | 1/2005 | Kingsford |
| 6,901,791 | B1 | 6/2005 | Frenz et al. |
| 6,925,072 | B1 | 8/2005 | Grohn |
| 6,952,618 | B2 | 10/2005 | Davlin et al. |
| 7,013,223 | B1 | 3/2006 | Zhang et al. |
| 7,029,238 | B1 | 4/2006 | Zagars |
| 7,063,785 | B2 | 6/2006 | Hiraku et al. |
| 7,083,202 | B2 | 8/2006 | Eberle et al. |
| 7,156,115 | B2 | 1/2007 | Everett et al. |
| 7,175,397 | B2 | 2/2007 | Claude et al. |
| 7,247,245 | B1 | 7/2007 | Proulx et al. |
| 7,249,628 | B2 | 7/2007 | Pillion et al. |
| 7,272,452 | B2 | 9/2007 | Coogan et al. |
| 7,383,967 | B2 | 6/2008 | Gibson |
| 7,454,317 | B2 | 11/2008 | Karasawa |
| 7,476,087 | B2 | 1/2009 | Zagars et al. |
| 7,494,265 | B2 | 2/2009 | Niermeyer et al. |
| 7,547,049 | B2 | 6/2009 | Gashgaee |
| 7,684,446 | B2 | 3/2010 | McLoughlin |
| 7,878,765 | B2 | 2/2011 | Gonnella et al. |
| 8,025,486 | B2 | 9/2011 | Gonnella et al. |
| 8,029,247 | B2 | 10/2011 | Cedrone et al. |
| 8,083,498 | B2 | 12/2011 | Gonnella et al. |
| 8,087,429 | B2 | 1/2012 | Cedrone et al. |
| 8,172,546 | B2 | 5/2012 | Cedrone et al. |
| 8,292,598 | B2 | 10/2012 | Laverdiere et al. |
| 8,322,994 | B2 | 12/2012 | Claude et al. |
| 8,382,444 | B2 | 2/2013 | Gonnella et al. |
| 8,651,823 | B2 | 2/2014 | Cedrone et al. |
| 8,662,859 | B2 | 3/2014 | Gonnella et al. |
| 8,678,775 | B2 | 3/2014 | Gonnella et al. |
| 8,753,097 | B2 | 6/2014 | Cedrone et al. |
| 2001/0000865 | A1 | 5/2001 | Gaughan et al. |
| 2001/0014477 | A1 | 8/2001 | Pelc |

(56) References Cited

U.S. PATENT DOCUMENTS

| | | | |
|---|---|---|---|
| 2002/0044536 | A1 | 4/2002 | Izumi et al. |
| 2002/0095240 | A1 | 7/2002 | Sickinger |
| 2003/0033052 | A1 | 2/2003 | Hillen et al. |
| 2003/0040881 | A1 | 2/2003 | Steger |
| 2003/0062382 | A1 | 4/2003 | Savard et al. |
| 2003/0148759 | A1 | 8/2003 | Leliveld |
| 2003/0222798 | A1 | 12/2003 | Floros |
| 2004/0041854 | A1 | 3/2004 | Saito et al. |
| 2004/0050771 | A1 | 3/2004 | Gibson |
| 2004/0072450 | A1 | 4/2004 | Collins |
| 2004/0076526 | A1 | 4/2004 | Fukano et al. |
| 2004/0133728 | A1 | 7/2004 | Ellerbrock et al. |
| 2004/0172229 | A1 | 9/2004 | Aragones et al. |
| 2004/0208750 | A1 | 10/2004 | Masuda |
| 2004/0265151 | A1 | 12/2004 | Bertram |
| 2005/0025634 | A1 | 2/2005 | Bernard et al. |
| 2005/0042127 | A1 | 2/2005 | Ohtsuka et al. |
| 2005/0061722 | A1 | 3/2005 | Takao et al. |
| 2005/0113941 | A1 | 5/2005 | Ii et al. |
| 2005/0126985 | A1 | 6/2005 | Campbell |
| 2005/0151802 | A1 | 7/2005 | Neese et al. |
| 2005/0173458 | A1 | 8/2005 | Hiranaga et al. |
| 2005/0173463 | A1 | 8/2005 | Wesner |
| 2005/0182497 | A1 | 8/2005 | Nakano |
| 2005/0184087 | A1 | 8/2005 | Zagars |
| 2005/0197722 | A1 | 9/2005 | Varone et al. |
| 2005/0232296 | A1 | 10/2005 | Schultze et al. |
| 2005/0238497 | A1 | 10/2005 | Holst |
| 2005/0244276 | A1 | 11/2005 | Pfister et al. |
| 2006/0015294 | A1 | 1/2006 | Yetter et al. |
| 2006/0070960 | A1 | 4/2006 | Gibson |
| 2006/0083259 | A1 | 4/2006 | Metcalf et al. |
| 2006/0184264 | A1 | 8/2006 | Willis et al. |
| 2006/0257707 | A1 | 11/2006 | Kaschmitter et al. |
| 2007/0104586 | A1 | 5/2007 | Cedrone |
| 2007/0125796 | A1 | 6/2007 | Cedrone |
| 2007/0125797 | A1 | 6/2007 | Cedrone |
| 2007/0126233 | A1 | 6/2007 | Gashgaee |
| 2007/0127511 | A1 | 6/2007 | Cedrone |
| 2007/0128046 | A1 | 6/2007 | Gonnella |
| 2007/0128047 | A1 | 6/2007 | Gonnella |
| 2007/0128048 | A1 | 6/2007 | Gonnella |
| 2007/0128050 | A1 | 6/2007 | Cedrone |
| 2007/0206436 | A1 | 9/2007 | Niermeyer et al. |
| 2007/0217442 | A1 | 9/2007 | McLoughlin |
| 2007/0254092 | A1 | 11/2007 | Lin et al. |
| 2008/0036985 | A1 | 2/2008 | Clarke et al. |
| 2008/0089361 | A1 | 4/2008 | Metcalf et al. |
| 2008/0131290 | A1 | 6/2008 | Magoon et al. |
| 2009/0047143 | A1 | 2/2009 | Cedrone |
| 2009/0132094 | A1 | 5/2009 | Laverdiere et al. |
| 2011/0051576 | A1 | 3/2011 | Ashizawa et al. |
| 2011/0098864 | A1 | 4/2011 | Gonnella et al. |
| 2012/0057990 | A1 | 3/2012 | Cedrone et al. |
| 2012/0070313 | A1 | 3/2012 | Gonnella et al. |
| 2012/0091165 | A1 | 4/2012 | Cedrone et al. |
| 2012/0288379 | A1 | 11/2012 | Laverdiere et al. |
| 2013/0004340 | A1 | 1/2013 | Gonnella et al. |
| 2014/0044570 | A1 | 2/2014 | Cedrone et al. |
| 2014/0127034 | A1 | 5/2014 | Gonnella et al. |

FOREIGN PATENT DOCUMENTS

| | | | |
|---|---|---|---|
| CA | 2246826 | | 3/1999 |
| CN | 1331783 | A | 1/2002 |
| CN | 1434557 | | 8/2003 |
| CN | 1526950 | A | 9/2004 |
| CN | 1582203 | | 2/2005 |
| CN | 1590761 | A | 3/2005 |
| CN | 1685156 | | 10/2005 |
| CN | 1695009 | A | 11/2005 |
| DE | 299 09 100 | U1 | 8/1999 |
| DE | 199 33 202 | A1 | 1/2001 |
| EP | 0 249 655 | A | 12/1987 |
| EP | 0 410 394 | A | 1/1991 |
| EP | 0513843 | A1 | 11/1992 |
| EP | 0 261 972 | B1 | 12/1992 |
| EP | 0577104 | A1 | 1/1994 |
| EP | 0 863 538 | A2 | 9/1998 |
| EP | 0 867 649 | A2 | 9/1998 |
| EP | 0 892 204 | A2 | 1/1999 |
| EP | 1 133 639 | B1 | 6/2004 |
| EP | 1 462 652 | A2 | 9/2004 |
| GB | 661 522 | A | 11/1951 |
| JP | 54-081119 | | 6/1979 |
| JP | 55-073563 | | 6/1980 |
| JP | 58-119983 | | 7/1983 |
| JP | 58-203340 | A | 11/1983 |
| JP | 61-178582 | | 8/1986 |
| JP | 63-255575 | | 10/1988 |
| JP | 02-13184 | | 1/1990 |
| JP | 02-091485 | | 3/1990 |
| JP | H02-227794 | | 9/1990 |
| JP | 04-167916 | | 6/1992 |
| JP | 05-184827 | | 7/1993 |
| JP | 51-081413 | | 7/1993 |
| JP | 6-58246 | | 3/1994 |
| JP | 06-103688 | | 4/1994 |
| JP | H07-253081 | | 10/1995 |
| JP | 08-016563 | | 1/1996 |
| JP | 08-61246 | | 3/1996 |
| JP | 2633005 | | 4/1997 |
| JP | 10-169566 | | 6/1998 |
| JP | 11-26430 | A | 1/1999 |
| JP | 11-076394 | | 3/1999 |
| JP | 2963514 | | 8/1999 |
| JP | 11-356081 | | 12/1999 |
| JP | 54-165812 | | 6/2000 |
| JP | 2001-203196 | | 7/2001 |
| JP | 2001-304650 | | 10/2001 |
| JP | 2001-342989 | | 12/2001 |
| JP | 2002-106467 | | 4/2002 |
| JP | 2002-305890 | | 10/2002 |
| JP | 2003-021069 | | 1/2003 |
| JP | 2003-516820 | | 5/2003 |
| JP | 2003-293958 | | 10/2003 |
| JP | 2004-032916 | | 1/2004 |
| JP | 2004-052748 | | 2/2004 |
| JP | 2004-143960 | | 5/2004 |
| JP | 2004-225672 | | 8/2004 |
| JP | 2004-232616 | | 8/2004 |
| JP | 2004-293443 | | 10/2004 |
| JP | 2005-090410 | | 4/2005 |
| JP | 2006-504035 | | 2/2006 |
| JP | 2006-161677 | | 6/2006 |
| JP | 2009-517601 | | 4/2009 |
| JP | 2009-517618 | | 4/2009 |
| JP | 2009-517778 | | 4/2009 |
| JP | 2009-517888 | | 4/2009 |
| JP | 2009-521636 | | 6/2009 |
| TW | 466301 | | 12/2001 |
| TW | 477862 | B | 3/2002 |
| TW | 593888 | | 6/2004 |
| TW | 1225908 | B | 1/2005 |
| WO | WO 96/35876 | A | 11/1996 |
| WO | WO 99/37435 | | 7/1999 |
| WO | WO 99/66415 | A1 | 12/1999 |
| WO | WO 00/31416 | A1 | 6/2000 |
| WO | WO 01/40646 | A3 | 6/2001 |
| WO | WO 01/43798 | | 6/2001 |
| WO | WO 02/090771 | A2 | 11/2002 |
| WO | WO 2006/057957 | A2 | 6/2006 |
| WO | WO 2007/067359 | A2 | 6/2007 |
| WO | WO 2009/059324 | | 5/2009 |

OTHER PUBLICATIONS

English translation of Office Action for Chinese Patent Application No. 200780046952.5, Chinese Patent Office, mailed Feb. 28, 2012, 5 pgs.

Office Action for U.S. Appl. No. 11/948,585, mailed Mar. 14, 2012, 14 pgs.

(56) References Cited

OTHER PUBLICATIONS

Notice of Allowance for U.S. Appl. No. 11/602,472, mailed Mar. 29, 2012, 11 pgs.
Office Action for Japanese Patent Application No. 2008-541407, Japanese Patent Office, mailed Mar. 27, 2012, 7 pgs. (with English translation).
Office Action for Japanese Patent Application No. 2008-543343, Japanese Patent Office, mailed Mar. 27, 2012, 6 pgs. (with English translation).
Office Action (with English translation) for Japanese Patent Application No. 2008-541407, mailed Dec. 21, 2012, 7 pgs.
Notice of Allowance for U.S. Appl. No. 12/218,325, mailed Jan. 24, 2013, 4 pgs.
Office Action (with English translation) for Japanese Patent Application No. 2009-539238, mailed Jan. 29, 2013, 5 pgs.
Office Action (with English translation) for Japanese Patent Application No. 2008-543354, mailed Jan. 29, 2013, 6 pgs.
Office Action (English translation only) for Korean Patent Application No. 10-2008-7015803, dated Feb. 13, 2013, 3 pgs.
Office Action (with English translation) for Korean Patent Application No. 10-2008-7013326, dated Feb. 13, 2013, 6 pgs.
Office Action for Chinese Patent Application No. 200680051448.X, dated Feb. 21, 2012, 3 pgs., Chinese Patent Office.
Office Action for Chinese Patent Application No. 200580039961.2, dated Apr. 12, 2012 (with English translation) 6 pgs.
Office Action for U.S. Appl. No. 11/948,585, mailed May 10, 2013, 12 pgs.
Office Action for Taiwan Patent Application No. 094140888, mailed Mar. 20, 2012, 5 pgs.
Office Action for Korea Patent Application No. 10-2007-7014324, mailed May 18, 2012, 6 pgs.
Office Action for Chinese Patent Application No. 200680050665.7, mailed Jul. 4, 2012, 12 pgs. (with English translation).
Notice of Allowance for U.S. Appl. No. 12/983,737, mailed Jul. 30, 2012, 9 pgs.
Notice of Allowance for Japanese Patent Application No. 2007-543342, dated Jul. 31, 2007, 3 pgs., Japanese Patent Office.
Office Action (with English translation) for Japanese Patent Application No. 2012-085238, mailed Aug. 20, 2013, 7 pgs., Japanese Patent Office.
Office Action (with English translation) for Japanese Patent Application No. 2008-544358, mailed Nov. 13, 2012, 2 pgs.
Office Action (with English translation) for Japanese Patent Application No. 2008-543344, mailed Nov. 13, 2012, 4 pgs.
Office Action (with English translation) for Japanese Patent Application No. 2008-543355, mailed Nov. 13, 2012, 4 pgs.
Office Action (with English translation) for Taiwan Patent Application No. 095142923, dated Aug. 29, 2012, 9 pgs.
Office Action (with English translation) for Taiwan Patent Application No. 096106723, dated Sep. 21, 2012, 8 pgs.
Notice of Allowability for U.S. Appl. No. 11/666,124, mailed May 8, 2012, 9 pgs.
Office Action for Japanese Patent Application No. 2009-539238, mailed Apr. 24, 2012, 6 pgs. (with English translation).
Office Action for European Patent Application No. 07836336.3, mailed May 15, 2012, 5 pgs.
Office Action for Chinese Patent Application No. 200680051205.6, mailed May 24, 2012, 7 pgs. (with English translation).
Office Action for U.S. Appl. No. 13/301,516, mailed Jun. 4, 2013, 8 pgs.
Office Action for Japanese Patent Application No. 2008-543342, mailed Jun. 5, 2012, 8 pgs. (with English translation).
Office Action for Japanese Patent Application No. 2008-543354, mailed Jul. 24, 2012, 6 pgs. (with English translation).
Office Action and Search Report for Taiwan Patent Application No. 095142929, issued Aug. 17, 2012, from the Intellectual Property Office of Taiwan, 7 pgs. (with English translation).
Office Action for U.S. Appl. No. 12/218,325, mailed Aug. 28, 2012, 9 pgs.
Office Action for U.S. Appl. No. 11/948,585, mailed Sep. 28, 2012, 17 pgs.
Office Action (with English translation) for Taiwan Patent Application No. 095143263, dated Aug. 17, 2012, 9 pgs.
Office Action (with English translation) for Japanese Patent Application No. 2008-541406, mailed Oct. 16, 2012, 7 pgs.
Office Action for U.S. Appl. No. 13/216,944, mailed Oct. 25, 2012, 12 pgs.
Notice of Allowance for U.S. Appl. No. 12/983,737, mailed Nov. 1, 2012, 7 pgs.
Office Action for Chinese Patent Application No. 200680051448.X, dated Nov. 2, 2012, 3 pgs.
Notice of Allowance for U.S. Appl. No. 12/983,737, mailed Dec. 6, 2012, 5 pgs.
Office Action (with English translation) for Chinese Patent Application No. 200780046952.5, dated Dec. 4, 2012, 5 pgs.
Office Action (with English translation) for Taiwanese Patent Application No. 094140888, dated Nov. 19, 2012, 6 pgs.
Brochure describing a Chempure Pump—A Furon Product, 1996, Furon Company, Anaheim, CA 92806, USA, 2 pgs.
Krishna et al.,"Characterization of Low Viscosity Photoresist Coating," Advances in Resist Tech. and Processing XV (Proceedings of SPIE (The Int'l Society of Optical Engineering), 2/23-25/98, Santa Clara, CA, vol. 3333 (Part Two of Two Parts), 15 pgs.
English translation of Chinese Patent Office Official Action, Chinese Patent Application No. 200410079193.0, 5 pgs.
International Search Report and Written Opinion, for International Patent Application No. PCT/US2006/045127 mailed May 23, 2007, 7 pgs.
International Search Report and Written Opinion, for International Patent Application No. PCT/US2006/044908 mailed Jul. 16, 2007, 10 pgs.
International Search Report and Written Opinion, for International Patent Application No. PCT/US2006/045175 mailed Jul. 25, 2007, 8 pgs.
International Search Report and Written Opinion, for International Patent Application No. PCT/US2006/044907 mailed Aug. 8, 2007, 9 pgs.
International Search Report and Written Opinion, for International Patent Application No. PCT/US2006/045177 mailed Aug. 9, 2007, 7 pgs.
European Patent Office Official Action, European Patent Application No. 00982386.5 dated Sep. 4, 2007, 8 pgs.
International Search Report and Written Opinion, for International Patent Application No. PCT/US2006/044906 mailed Sep. 5, 2007, 8 pgs.
International Search Report and Written Opinion, for International Patent Application No. PCT/US2005/042127 mailed Sep. 26, 2007, 8 pgs.
International Search Report and Written Opinion, for International Patent Application No. PCT/US2006/044980 mailed Oct. 4, 2007, 9 pgs.
Office Action for U.S. Appl. No. 11/051,576, mailed Dec. 13, 2007, 21 pgs.
International Search Report and Written Opinion, for International Patent Application No. PCT/US2006/045176, mailed Apr. 21, 2006, 9 pgs.
Office Action for U.S. Appl. No. 11/602,513, mailed May 22, 2008, 10 pgs.
International Search Report and Written Opinion, for International Patent Application No. PCT/US2007/05377, mailed Jun. 4, 2008, 13 pgs.
Chinese Patent Office Official Action (with English translation) for Chinese Patent Application No. 2005101088364, issued May 23, 2008, 6 pgs.
International Search Report and Written Opinion for International Patent Application No. PCT/US06/44985, mailed Jun. 23, 2008, 7 pgs.
International Search Report and Written Opinion for International Patent Application No. PCT/US07/17017, mailed Jul. 3, 2008, 9 pgs.
International Search Report and Written Opinion for International Patent Application No. PCT/US06/44981, mailed Aug. 8, 2008, 10 pgs.

(56) References Cited

OTHER PUBLICATIONS

Office Action for U.S. Appl. No. 11/365,395, mailed Aug. 19, 2008, 19 pgs.
Office Action for U.S. Appl. No. 11/292,559 mailed Aug. 28, 2008, 19 pgs.
Office Action for U.S. Appl. No. 11/602,513, mailed Nov. 14, 2008, 7 pgs.
Office Action for U.S. Appl. No. 11/364,286, mailed Nov. 14, 2008, 11 pgs.
International Preliminary Report on Patentability, Chap. II, for International Patent Application No. PCT/US07/17017, mailed Jan. 13, 2009, 8 pgs.
International Preliminary Report on Patentability, Chap. I, for International Patent Application No. PCT/US2006/044981, mailed Nov. 6, 2008, 7 pgs.
International Preliminary Report on Patentability, Chap. II, for International Patent Application No. PCT/US2006/044981, mailed Feb. 2, 2009, 9 pgs.
Office Action for U.S. Appl. No. 11/365,395, mailed Feb. 2, 2009, 18 pgs.
Office Action for U.S. Appl. No. 11/292,559, mailed Dec. 24, 2008, 18 pgs.
International Preliminary Report on Patentability, Ch. I, for International Patent Application No. PCT/US2006/044985, mailed Apr. 9, 2009, 5 pgs.
Office Action for U.S. Appl. No. 11/292,559, mailed Apr. 17, 2009, 20 pgs.
Office Action for U.S. Appl. No. 11/273,091, mailed Feb. 17, 2006, 8 pgs.
Office Action for U.S. Appl. No. 11/273,091, mailed Jul. 3, 2006, 8 pgs.
Office Action for U.S. Appl. No. 11/273,091 mailed Oct. 13, 2006, 8 pgs.
Office Action for U.S. Appl. No. 11/273,091 mailed Feb. 23, 2007, 6 pgs.
Office Action for U.S. Appl. No. 11/273,091 mailed Oct. 15, 2007, 8 pgs.
Office Action for U.S. Appl. No. 11/386,427 mailed Nov. 13, 2007, 11 pgs.
Office Action for U.S. Appl. No. 11/364,286 mailed Jun. 1, 2009, 14 pgs.
International Preliminary Report on Patentability, Ch. I, for International Patent Application No. PCT/US2006/045176, issued on Mar. 31, 2009, 5 pgs.
Intellectual Property Office of Singapore, Written Opinion for Patent Application No. 200803948-9 dated Jul. 2, 2009, 10 pgs.
International Search Report for International Patent Application No. PCT/US99/28002, mailed Mar. 14, 2000, 5 pgs.
Written Opinion for International Patent Application No. PCT/US99/28002, mailed Oct. 25, 2000, 8 pgs.
International Preliminary Examination Report for International Patent Application No. PCT/US99/28002, mailed Feb. 21, 2001, 9 pgs.
International Search Report and Written Opinion for International Patent Application No. PCT/US06/44907, mailed Aug. 8, 2007, 9 pgs.
International Preliminary Report on Patentability, Chap. I, for International Patent Application No. PCT/US06/044906, mailed Jun. 5, 2008, 7 pgs.
International Preliminary Report on Patentability, Chap. I, for International Patent Application No. PCT/US2006/044907, mailed Jun. 5, 2008, 7 pgs.
International Preliminary Report on Patentability, Chap. I, for International Patent Application No. PCT/US2006/044980, mailed Jun. 12, 2008, 7 pgs.
International Preliminary Report on Patentability, Chap. I, for International Patent Application No. PCT/US2006/044908, mailed Jun. 12, 2008, 8 pgs.
International Preliminary Report on Patentability, Chap. I, for International Patent Application No. PCT/US2006/045175, mailed Jun. 12, 2008, 6 pgs.
International Preliminary Report on Patentability, Chap. I, for International Patent Application No. PCT/US2006/045127, mailed Jun. 12, 2008, 8 pgs.
International Preliminary Report on Patentability, Chap. I, for International Patent Application No. PCT/US2006/045177, mailed Jun. 19, 2008, 5 pgs.
International Preliminary Report on Patentability, Chap. II, for International Patent Application No. PCT/US07/05377, mailed Oct. 14, 2008, 14 pgs.
European Search Report for European Application No. 06838223.3, European Patent Office, dated Aug. 12, 2009, 18 pgs.
Japanese Laid Open Publication No. JP-2009-528631, published Aug. 6, 2009, with International Search Report, Japanese Patent Office, 38 pgs.
Office Action for U.S. Appl. No. 09/447,504 mailed Feb. 27, 2001, 4 pgs.
Office Action for U.S. Appl. No. 09/447,504 mailed Nov. 18, 2003, 4 pgs.
Office Action for U.S. Appl. No. 09/447,504 mailed Jul. 13, 2004, 5 pgs.
Japanese Laid Open Publication No. JP-2009-529847, published Aug. 20, 2009, with International Search Report, Japanese Patent Office, 21 pgs.
Intellectual Property Office of Singapore, Examination Report for Patent Application No. 200703671-8 dated Jul. 28, 2009, 4 pgs.
Chinese Patent Office Official Action, Chinese Patent Application No. 200580039961.2, dated Aug. 21, 2009 with English translation, 33 pgs.
Intellectual Property Office of Singapore, Written Opinion for Patent Application No. 200806425-5 dated Oct. 14, 2009, 8 pgs.
Office Action for U.S. Appl. No. 11/602,507 mailed Oct. 28, 2009, 12 pgs.
Office Action for U.S. Appl. No. 11/292,559 mailed Nov. 3, 2009, 17 pgs.
Office Action for U.S. Appl. No. 11/364,286 mailed Nov. 9, 2009, 19 pgs.
Office Action issued Chinese Patent Appl. No. 200680050665.7, dated Mar. 11, 2010, (with English translation) 6 pgs.
Office Action for U.S. Appl. No. 11/364,286 mailed Apr. 7, 2010, 22 pgs.
Office Action for U.S. Appl. No. 11/292,559 mailed Apr. 14, 2010, 20 pgs.
Office Action for U.S. Appl. No. 11/602,508 mailed Apr. 15, 2010, 20 pgs.
Office Action for Chinese Patent Application No. CN 200680050801.2, mailed Mar. 26, 2010, 13 pgs.
Supplementary European Search Report and European Written Opinion in Application No. EP06838071.6, dated Apr. 28, 2010, 5 pgs.
Office Action for U.S. Appl. No. 11/602,485 mailed Jun. 9, 2010, 9 pgs.
Office Action for U.S. Appl. No. 11/602,507 mailed Jun. 14, 2010, 13 pgs.
Office Action for U.S. Appl. No. 11/602,472 mailed Jun. 18, 2010, 13 pgs.
Office Action for U.S. Appl. No. 11/602,465 mailed Jun. 18, 2010, 14 pgs.
Office Action for U.S. Appl. No. 11/602,464 mailed Jun. 21, 2010, 19 pgs.
Office Action (with English translation) for Chinese Patent Application No. CN 200680045074.0, mailed Jun. 7, 2010, 8 pgs.
Office Action (with English translation) for Chinese Patent Application No. CN 200680050814.X, mailed Aug. 6, 2010, 10 pgs.
Notice of Allowance for U.S. Appl. No. 11/364,286 mailed Sep. 21, 2010, 11 pgs.
Notice of Allowance for U.S. Appl. No. 11/602,507 mailed Oct. 14, 2010, 8 pgs.
Office Action (with English translation) for Chinese Patent Application No. CN 200780046952.5, mailed Sep. 27, 2010, 8 pgs.

(56) References Cited

OTHER PUBLICATIONS

Office Action for U.S. Appl. No. 11/602,485 mailed Nov. 19, 2010, 9 pgs.
Notice of Allowance for U.S. Appl. No. 11/602,508, mailed Dec. 14, 2010, 10 pgs.
Official Action (with English translation) for Chinese Patent Application No. 200680051448.X, mailed Dec. 1, 2010, 20 pgs.
Office Action for U.S. Appl. No. 11/602,464 mailed Jan. 5, 2011, 12 pgs.
Notice of Allowance for U.S. Appl. No. 11/602,465, mailed Jan. 12, 2011, 19 pgs.
Office Action for Chinese Patent Application No. 200680050801.2, dated Jan. 6, 2011, with English translation, 7 pgs.
Notice of Allowance for U.S. Appl. No. 11/602,508, mailed Mar. 4, 2011, 8 pgs.
Office Action for Japanese Patent Application No. 2007-543342, dated Feb. 25, 2011, mailed Mar. 1, 2011, Japanese Patent Office, 12 pgs. with English translation.
Office Action for U.S. Appl. No. 11/602,472, mailed Mar. 21, 2011, 11 pgs.
European Search Report and Written Opinion for European Patent Application No. 06838070.8, dated Mar. 18, 2011, 7 pgs.
European Office Action for European Patent Application No. 06838071.6, dated Mar. 18, 2011, 5 pgs.
Office Action for U.S. Appl. No. 11/602,485, mailed Apr. 27, 2011, 16 pgs.
Office Action for Chinese Patent Application No. 200680050665.7 mailed Apr. 26, 2011, Chinese Patent Office, 11 pgs. (with English translation).
Office Action for U.S. Appl. No. 11/948,585, mailed May 19, 2011, 59 pgs.
Notice of Allowance for U.S. Appl. No. 11/602,465, mailed Jun. 8, 2011, 15 pgs.
Chinese Office Action for Chinese Patent Application No. 200680045074.0, Chinese Patent Office, dated Jun. 2, 2011, 10 pgs. (with English translation).
Notice of Allowance for U.S. Appl. No. 11/602,464, mailed Jul. 11, 2011, 12 pgs.
Notice of Allowance for U.S. Appl. No. 11/602,508, mailed Jul. 20, 2011, 11 pgs.
Office Action for Chinese Patent Application No. 200680043297.3, Chinese Patent Office, dated Jul. 27, 2011 (with English translation), 8 pgs.
Office Action for Chinese Patent Application No. 200580039961.2, Chinese Patent Office, dated Aug. 9, 2011, 6 pgs.
European Search Report for European Patent Application No. 06844456.1, European Patent Office, dated Jun. 28, 2011, 9 pgs.
Notice of Allowance for U.S. Appl. No. 11/602,472, mailed Sep. 8, 2011, 25 pgs.
Office Action for Chinese Patent Application No. 200680050801.2 dated Chinese Patent Office, Aug. 31, 2011, 5 pgs. (English translation only).
European Search Report for European Patent Application No. 07836336.3, European Patent Office, dated Sep. 19, 2011, 5 pgs.
Office Action for Chinese Patent Application No. 200680051205.6, dated Oct. 10, 2011, State Intellectual Property Office of the People's Republic of China, 9 pgs., English translation only.
Office Action for Korean Patent Application No. 10-2007-7014324, dated Oct. 31, 2011, Korean Patent Office, 18 pgs.
English translation of Office Action for Chinese Patent Application No. 200680050665.7 dated Nov. 23, 2011, 7 pgs.
Office Action for U.S. Appl. No. 12/218,325, mailed Dec. 13, 2011, 70 pgs.
English translation of Office Action for Chinese Patent Application No. 200680050801.2 dated Dec. 1, 2011, 3 pgs.
Office Action for Japanese Patent Application No. 2008-543354, mailed Dec. 22, 2011, Japanese Patent Office, 7 pgs. (with English translation).
Office Action for Chinese Patent Application No. 200680050814.X, dated Dec. 23, 2011, State Intellectual Property Office of the People's Republic of China, 6 pgs.(with English translation).
Office Action for Japanese Patent Application No. 2008-543344, mailed Feb. 2, 2012, Japanese Patent Office, 6 pgs. (with English translation).
Office Action for Japanese Patent Application No. 2008-544358, mailed Feb. 1, 2012, Japanese Patent Office, 6 pgs. (with English translation).
Office Action for U.S. Appl. No. 13/615,926, mailed Mar. 15, 2013, 17 pgs.
Notice of Allowance for U.S. Appl. No. 13/216,944, mailed Mar. 19, 2013, 2 pgs.
Office Action for Japanese Patent Application No. 2008-543355, mailed Jan. 5, 2012, Japanese Patent Office, 5 pgs. (with English translation).
Office Action for Japanese Patent Application No. 2008-541406, mailed Jan. 10, 2012, Japanese Patent Office, 11 pgs. (with English translation).
Office Action for U.S. Appl. No. 11/948,585, mailed Jan. 19, 2012, 19 pgs.
Office Action for U.S. Appl. No. 13/615,926, mailed Jun. 19, 2013, 17 pgs.
Notice of Allowance for Taiwan Application No. 095142923, dated Jun. 26, 2013, 5 pgs. (with English translation of search report only), Taiwan Intellectual Property Office.
Notice of Allowance for Taiwan Application No. 095142926, dated Jun. 27, 2013, 5 pgs. (with English translation of search report only), Taiwan Intellectual Property Office.
Notice of Allowance for Japanese Patent Application No. 2008-541406, dated Jul. 9, 2013, 3 pgs., Japanese Patent Office.
Notice of Allowance for Japanese Patent Application No. 2008-541407, dated Jul. 9, 2013, 3 pgs., Japanese Patent Office.
Notice of Allowance for Japanese Patent Application No. 2008-544358, dated Jul. 16, 2013, 3 pgs., Japanese Patent Office.
Office Action (with English translation) for Japanese Patent Application No. 2011-168830, mailed Jul. 23, 2013, 6 pgs., Japanese Patent Office.
Office Action (with English translation) for Japanese Patent Application No. 2012-059979, mailed Jul. 23, 2013, 6 pgs., Japanese Patent Office.
Office Action for Taiwanese Patent Application No. 095142926, issued Aug. 9, 2012, 12 pgs. (with English translation).
Office Action for Taiwanese Patent Application No. 095142932, issued Aug. 17, 2012, 9 pgs. (with English translation).
Office Action for Taiwanese Patent Application No. 095142928, issued Aug. 17, 2012, 9 pgs. (with English translation).
Office Action (with English translation) for Korean Patent Application No. 10-2008-7015528, dated Apr. 22, 2013, 15 pgs., Korean Patent Office.
Office Action (with English translation) for Japanese Patent Application No. 2012-087168, mailed Sep. 24, 2013, 6 pgs., Japanese Patent Office.
Office Action (with English translation) for Taiwanese Patent Application No. 095142930, issued Sep. 18, 2013, 8 pgs.
Office Action for U.S. Appl. No. 13/554,746, mailed Oct. 25, 2013, 10 pgs.
Office Action for U.S. Appl. No. 13/316,093, mailed Oct. 29, 2013, 7 pgs.
Notice of Allowance for U.S. Appl. No. 13/615,926, mailed Nov. 20, 2013, 5 pgs.
Notice of Allowance for U.S. Appl. No. 13/301,516, mailed Nov. 21, 2013, 5 pgs.
Office Action (with English translation) for Japanese Patent Application No. 2009-539238, mailed Dec. 3, 2013, 3 pgs.
Office Action (with English translation) for Japanese Patent Application No. 2013-018339, mailed Dec. 3, 2013, 7 pgs.
Notice of Allowance for U.S. Appl. No. 11/948,585, mailed Dec. 19, 2013, 5 pgs.
Office Action (with English translation) for Japanese Patent Application No. 2012-059979, mailed Dec. 17, 2013, 4 pgs.
Corrected Notice of Allowability for U.S. Appl. No. 13/615,926, mailed Feb. 4, 2014, 6 pgs.

(56) References Cited

OTHER PUBLICATIONS

Notice of Allowance for Japanese Patent Application No. 2012-085238, dated Mar. 10, 2014, 3 pages.
Office Action (with English translation) for Japanese Patent Application No. 2013-086392, mailed Mar. 3, 2014, 8 pgs.
Office Action for Chinese Patent Application No. 201210151908.3, dated Apr. 30, 2014, 19 pgs.
Office Action (with English translation) for Japanese Patent Application No. 2011-168830, mailed Jun. 2, 2014, 9 pgs.
Office Action for U.S. Appl. No. 13/316,093, mailed Jun. 23, 2014, 8 pgs.
Notice of Allowance for Japanese Patent Application No. 2009-539238, dated Jun. 23, 2014, 3 pgs.
Notice of Allowance for U.S. Appl. No. 13/554,749, mailed Jun. 5, 2014, 3 pgs.
Notice of Allowance for Japanese Patent Application No. 2012-059979, dated Jun. 16, 2014, 3 pgs.

SYSTEM AND METHOD FOR PRESSURE COMPENSATION IN A PUMP

RELATED APPLICATIONS

This application is a continuation of and claims priority under 35 U.S.C. 120 of the filing date of U.S. patent application Ser. No. 11/602,508 by inventors James Cedrone et al., entitled "System and Method for Pressure Compensation in a Pump" filed on Nov. 20, 2006, which in turn claims the benefit of priority under 35 U.S.C. §119 to U.S. Provisional Patent Application Ser. No. 60/741,682 by inventors George Gonnella and James Cedrone, entitled "System and Method For Pressure Compensation in a Pump" filed on Dec. 2, 2005, the entire contents of which are hereby expressly incorporated by reference for all purposes.

TECHNICAL FIELD OF THE INVENTION

This invention relates generally to fluid pumps. More particularly, embodiments of the present invention relate to multi-stage pumps. Even more particularly, embodiments of the present invention relate to compensating for pressure drift which may occur in a pump used in semiconductor manufacturing.

BACKGROUND OF THE INVENTION

There are many applications for which precise control over the amount and/or rate at which a fluid is dispensed by a pumping apparatus is necessary. In semiconductor processing, for example, it is important to control the amount and rate at which photochemicals, such as photoresist chemicals, are applied to a semiconductor wafer. The coatings applied to semiconductor wafers during processing typically require a flatness across the surface of the wafer that is measured in angstroms. The rates at which processing chemicals are applied to the wafer has to be controlled in order to ensure that the processing liquid is applied uniformly.

Many photochemicals used in the semiconductor industry today are very expensive, frequently costing as much as $1000 a liter. Therefore, it is preferable to ensure that a minimum but adequate amount of chemical is used and that the chemical is not damaged by the pumping apparatus. Current multiple stage pumps can cause sharp pressure spikes in the liquid. Such pressure spikes and subsequent drops in pressure may be damaging to the fluid (i.e., may change the physical characteristics of the fluid unfavorably). Additionally, pressure spikes can lead to built up fluid pressure that may cause a dispense pump to dispense more fluid than intended or dispense the fluid in a manner that has unfavorable dynamics.

More specifically, when an entrapped space is created within the pumping apparatus pressure drift (with respect to the initial pressure within the enclosed space) may occur for various reasons, such as the construction of various components of the pumping apparatus. This pressure drift may be particularly detrimental when it occurs in a dispense chamber containing fluid awaiting dispense. Thus, what is desired is a way to compensate for pressure drift within a pumping apparatus.

SUMMARY OF THE INVENTION

Systems and methods for maintaining substantially a baseline pressure in a chamber of a pumping apparatus are disclosed. Embodiments of the present invention may serve to control a motor to compensate or account for a pressure drift which may occur in a chamber of the pumping apparatus. More specifically, a dispense motor may be controlled to substantially maintain a baseline pressure in the dispense chamber before a dispense based on a pressure sensed in the dispense chamber. In one embodiment, before a dispense is initiated a control loop may be utilized such that it is repeatedly determined if the pressure in the dispense chamber differs from a desired pressure (e.g. above or below) and, if so, the movement of the pumping means regulated to maintain substantially the desired pressure in the dispense chamber until a dispense of fluid is initiated.

Embodiments of the present invention provide systems and methods for correcting for pressure drift that substantially eliminate or reduce the disadvantages of previously developed pumping systems and methods. More particularly, embodiments of the present invention provide a system and method to compensate for pressure drift which may occur in a ready segment of a dispense cycle of a multi-stage pump, when the multi-stage pump is idle, or at virtually any other time. After entering a ready segment the pressure within a dispense chamber of the multi-stage pump may be monitored, and any pressure variation (e.g. increase or decrease) detected may be corrected for by moving a dispense stage diaphragm. In one particular embodiment, a closed loop control system may monitor the pressure within the dispense chamber during a ready segment. If a pressure above a desired baseline pressure is detected, the closed loop control system may signal the dispense motor to reverse a single motor increment. In this manner, any pressure increases occurring during the ready segment may be corrected for and a baseline pressure desired for dispense may be substantially maintained.

Embodiments of the present invention provide an advantage by allowing a desired pressure in a dispense chamber to be substantially maintained during a ready segment, irrespective of the length of the ready segment.

Another embodiment of the present invention provides the advantage of allowing accurate dispenses and repeatability of dispenses between dispense segments.

Yet another embodiment of the present invention provides the advantage of allowing process recipe duplication (e.g. with systems having different baseline pressures) by virtue of allowing accurate and repeatable dispense.

Another embodiment of the present invention provides the advantage of achieving acceptable fluid dynamics during a dispense segments.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

A more complete understanding of the present invention and the advantages thereof may be acquired by referring to the following description, taken in conjunction with the accompanying drawings in which like reference numbers indicate like features and wherein.

DETAILED DESCRIPTION

Preferred embodiments of the present invention are illustrated in the FIGUREs, like numerals being used to refer to like and corresponding parts of the various drawings.

Embodiments of the present invention are related to a pumping system that accurately dispenses fluid using a pump, which may be a single stage pump or a multiple stage ("multi-stage") pump. More particularly, embodiments of the present invention provide systems and methods for correcting for pressure drift which may occur in a ready segment of a dispense cycle of a multi-stage pump (e.g. because valves are closed creating a trapped space, for example within a dispense chamber). After entering a ready segment the pressure within a dispense chamber of the multi-stage pump may be monitored, and any pressure variation detected may be corrected for by moving a dispense stage diaphragm. Embodiments of such a pumping system are disclosed in U.S. Provisional Patent Application Ser. No. 60/742,435 by inventors James Cedrone, George Gonnella and Iraj Gashgaee, filed Dec. 5, 2005 which is hereby incorporated by reference in its entirety.

Figure 1:
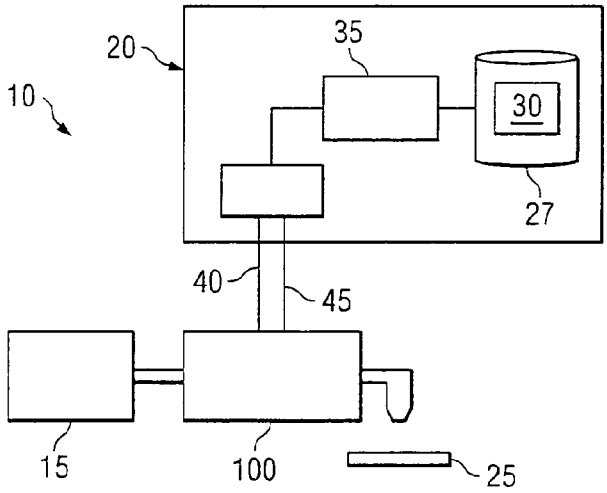
FIG. 1 is a diagrammatic representation of one embodiment of a pumping system.

FIG. 1 is a diagrammatic representation of one such embodiment of pumping system 10. The pumping system 10 can include a fluid source 15, a pump controller 20 and a multi-stage pump 100, which work together to dispense fluid onto a wafer 25. The operation of multi-stage pump 100 can be controlled by pump controller 20, which can be onboard multi-stage pump 100 or connected to multi-stage pump 100 via a one or more communications links for communicating control signals, data or other information. Additionally, the functionality of pump controller 20 can be distributed between an onboard controller and another controller. Pump controller 20 can include a computer readable medium 27 (e.g., RAM, ROM, Flash memory, optical disk, magnetic drive or other computer readable medium) containing a set of control instructions 30 for controlling the operation of multi-stage pump 100. A processor 35 (e.g., CPU, ASIC, RISC, DSP or other processor) can execute the instructions. One example of a processor is the Texas Instruments TMS320F2812PGFA 16-bit DSP (Texas Instruments is Dallas, Tex. based company). In the embodiment of FIG. 1, controller 20 communicates with multi-stage pump 100 via communications links 40 and 45. Communications links 40 and 45 can be networks (e.g., Ethernet, wireless network, global area network, DeviceNet network or other network known or developed in the art), a bus (e.g., SCSI bus) or other communications link. Controller 20 can be implemented as an onboard PCB board, remote controller or in other suitable manner. Pump controller 20 can include appropriate interfaces (e.g., network interfaces, I/O interfaces, analog to digital converters and other components) to controller to communicate with multi-stage pump 100. Additionally, pump controller 20 can include a variety of computer components known in the art including processors, memories, interfaces, display devices, peripherals or other computer components not shown for the sake of simplicity. Pump controller 20 can control various valves and motors in multi-stage pump to cause multi-stage pump to accurately dispense fluids, including low viscosity fluids (i.e., less than 100 centipoise) or other fluids. An I/O interface connector as described in U.S. Patent Application Ser. No. 60/741,657, entitled "I/O Interface System and Method for a Pump," by Cedrone et al., filed Dec. 2, 2005 and U.S. patent application Ser. No. 11/602,449, entitled "I/O Systems, Methods And Devices For Interfacing A Pump Controller", by Inventors Cedrone et al., filed Nov. 20, 2006, issued as U.S. Pat. No. 7,940,664 on May 10, 2011, which is hereby fully incorporated by reference herein, can be used to connected pump controller 20 to a variety of interfaces and manufacturing tools.

Figure 2:
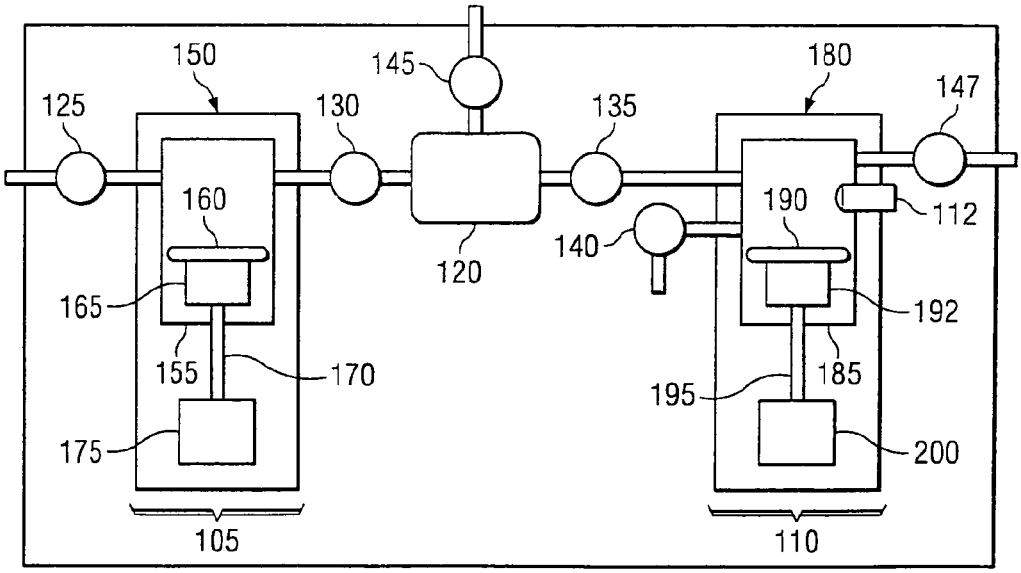
FIG. 2 is a diagrammatic representation of a multiple stage pump ("multi-stage pump") according to one embodiment of the present invention.

FIG. 2 is a diagrammatic representation of a multi-stage pump 100. Multi-stage pump 100 includes a feed stage portion 105 and a separate dispense stage portion 110. Located between feed stage portion 105 and dispense stage portion 110, from a fluid flow perspective, is filter 120 to filter impurities from the process fluid. A number of valves can control fluid flow through multi-stage pump 100 including, for example, inlet valve 125, isolation valve 130, barrier valve 135, purge valve 140, vent valve 145 and outlet valve 147. Dispense stage portion 110 can further include a pressure sensor 112 that determines the pressure of fluid at dispense stage 110. The pressure determined by pressure sensor 112 can be used to control the speed of the various pumps as described below. Example pressure sensors include ceramic and polymer pesioresistive and capacitive pressure sensors, including those manufactured by Metallux AG, of Korb, Germany. According to one embodiment, the face of pressure sensor 112 that contacts the process fluid is a perfluoropolymer. Pump 100 can include additional pressure sensors, such as a pressure sensor to read pressure in feed chamber 155.

Feed stage 105 and dispense stage 110 can include rolling diaphragm pumps to pump fluid in multi-stage pump 100. Feed-stage pump 150 ("feed pump 150"), for example, includes a feed chamber 155 to collect fluid, a feed stage diaphragm 160 to move within feed chamber 155 and displace fluid, a piston 165 to move feed stage diaphragm 160, a lead screw 170 and a stepper motor 175. Lead screw 170 couples to stepper motor 175 through a nut, gear or other mechanism for imparting energy from the motor to lead screw 170. According to one embodiment, feed motor 170 rotates a nut that, in turn, rotates lead screw 170, causing piston 165 to actuate. Dispense-stage pump 180 ("dispense pump 180") can similarly include a dispense chamber 185, a dispense stage diaphragm 190, a piston 192, a lead screw 195, and a dispense motor 200. Dispense motor 200 can drive lead screw 195 through a threaded nut (e.g., a Torlon or other material nut).

According to other embodiments, feed stage 105 and dispense stage 110 can be a variety of other pumps including pneumatically or hydraulically actuated pumps, hydraulic pumps or other pumps. One example of a multi-stage pump using a pneumatically actuated pump for the feed stage and a stepper motor driven hydraulic pump is described in U.S. patent application Ser. No. 11/051,576 entitled "Pump Controller For Precision Pumping Apparatus" by inventors Zagars et al., filed Feb. 4, 2005, hereby incorporated by reference. The use of motors at both stages, however, provides an advantage in that the hydraulic piping, control systems and fluids are eliminated, thereby reducing space and potential leaks.

Feed motor 175 and dispense motor 200 can be any suitable motor. According to one embodiment, dispense motor 200 is a Permanent-Magnet Synchronous Motor ("PMSM"). The PMSM can be controlled by a digital signal processor ("DSP") utilizing Field-Oriented Control ("FOC"), or other type of position/speed control known in the art, at motor 200, a controller onboard multi-stage pump 100 or a separate pump controller (e.g. as shown in FIG. 1). PMSM 200 can further include an encoder (e.g., a fine line rotary position encoder) for real time feedback of dispense motor 200's position. The use of a position sensor gives accurate and repeatable control of the position of piston 192, which leads to accurate and repeatable control over fluid movements in dispense chamber 185. For example, using a 2000 line encoder, which according to one embodiment gives 8000 pulses to the DSP, it is possible to accurately measure to and control at 0.045 degrees of rotation. In addition, a PMSM can run at low velocities with little or no vibration. Feed motor 175 can also be a PMSM or a stepper motor. It should also be noted that the feed pump can include a home sensor to indicate when the feed pump is in its home position.

Figure 3A:
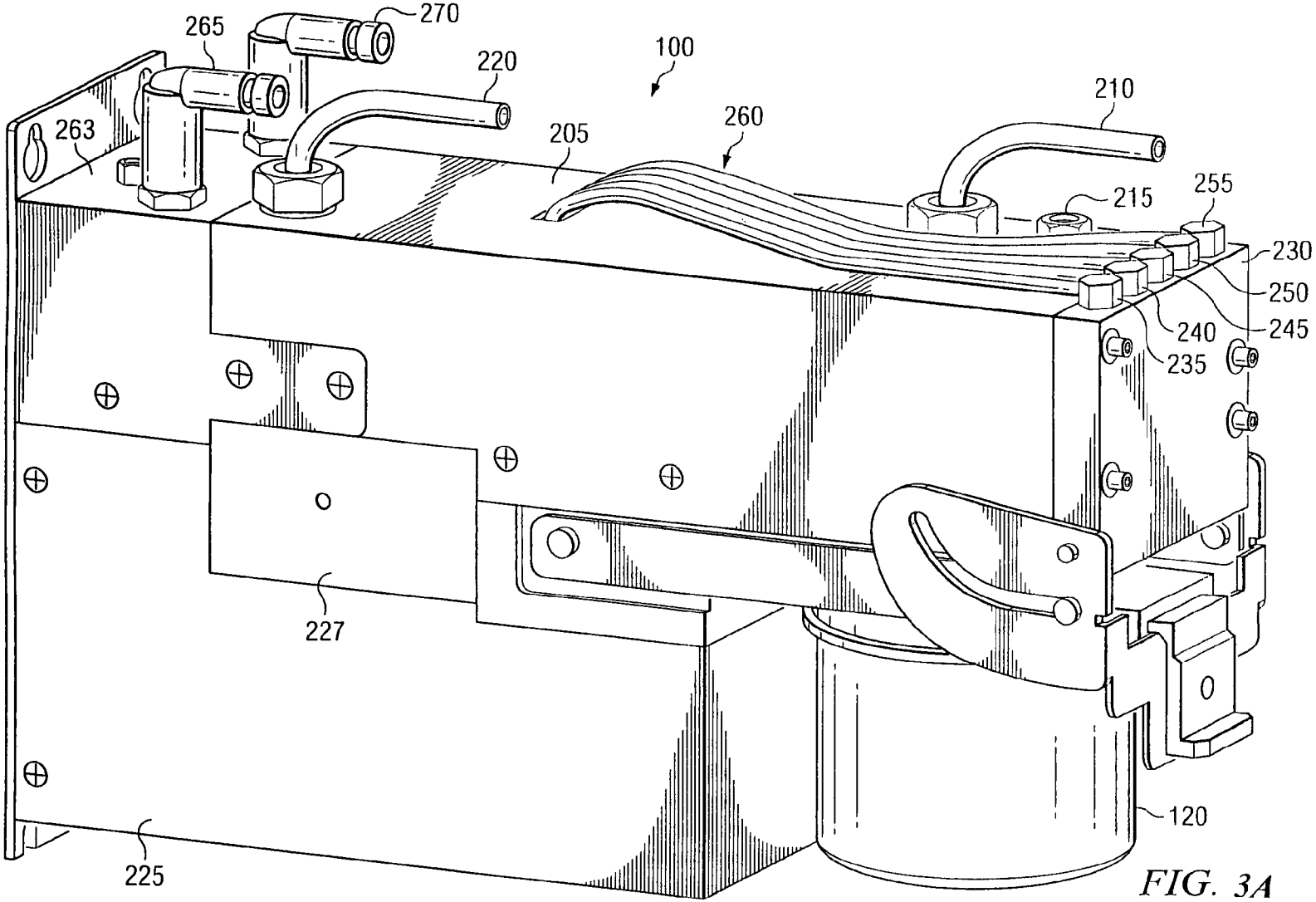
FIGS. 3A, 3B, 4A, 4C and 4D are diagrammatic representations of various embodiments of a multi-stage pump.

FIG. 3A is a diagrammatic representation of one embodiment of a pump assembly for multi-stage pump 100. Multi-stage pump 100 can include a dispense block 205 that defines various fluid flow paths through multi-stage pump 100 and at least partially defines feed chamber 155 and dispense chamber 185. Dispense pump block 205, according to one embodiment, can be a unitary block of PTFE, modified PTFE or other material. Because these materials do not react with or are minimally reactive with many process fluids, the use of these materials allows flow passages and pump chambers to be machined directly into dispense block 205 with a minimum of additional hardware. Dispense block 205 consequently reduces the need for piping by providing an integrated fluid manifold.

Figure 4A:
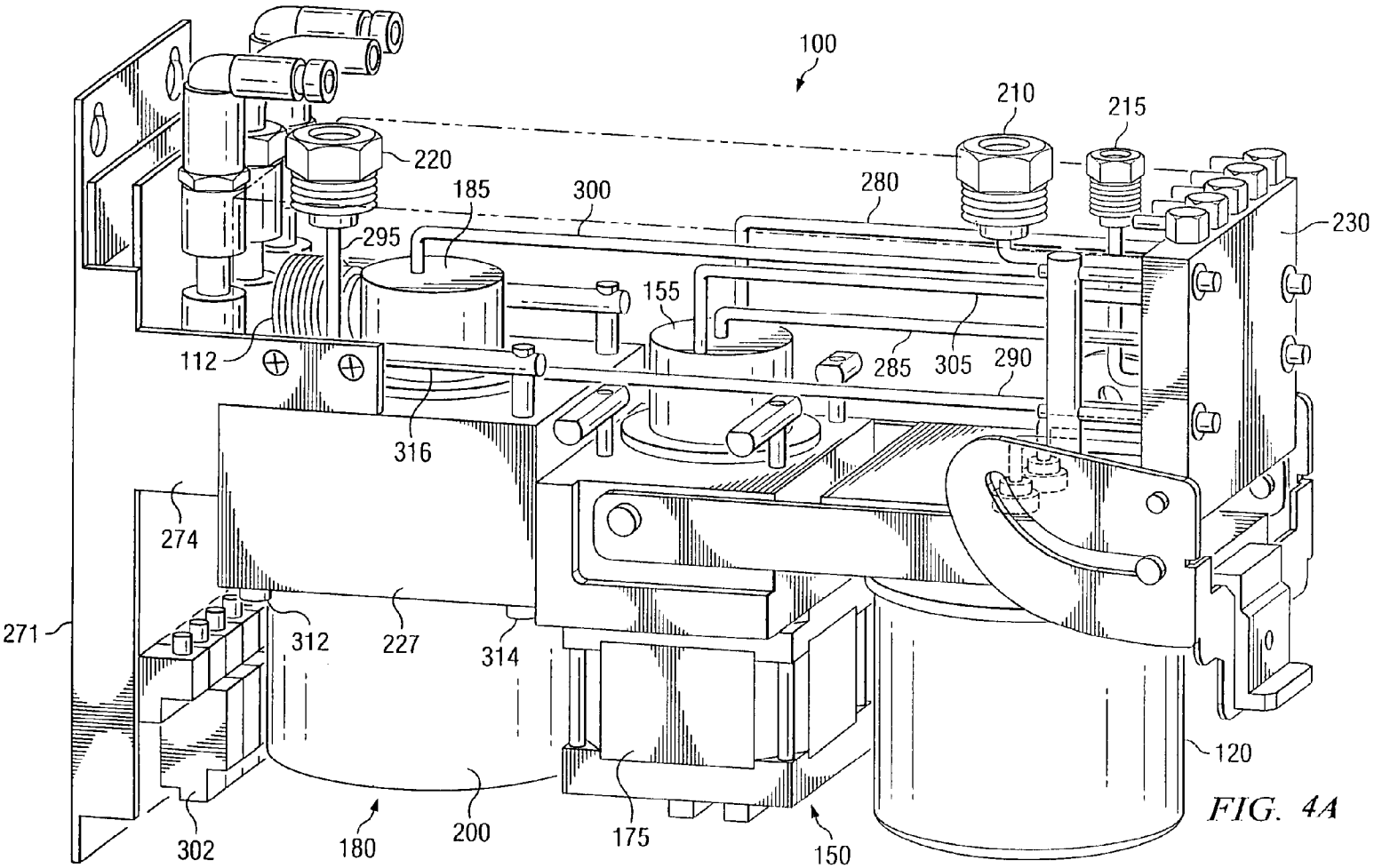
Figure 4B:
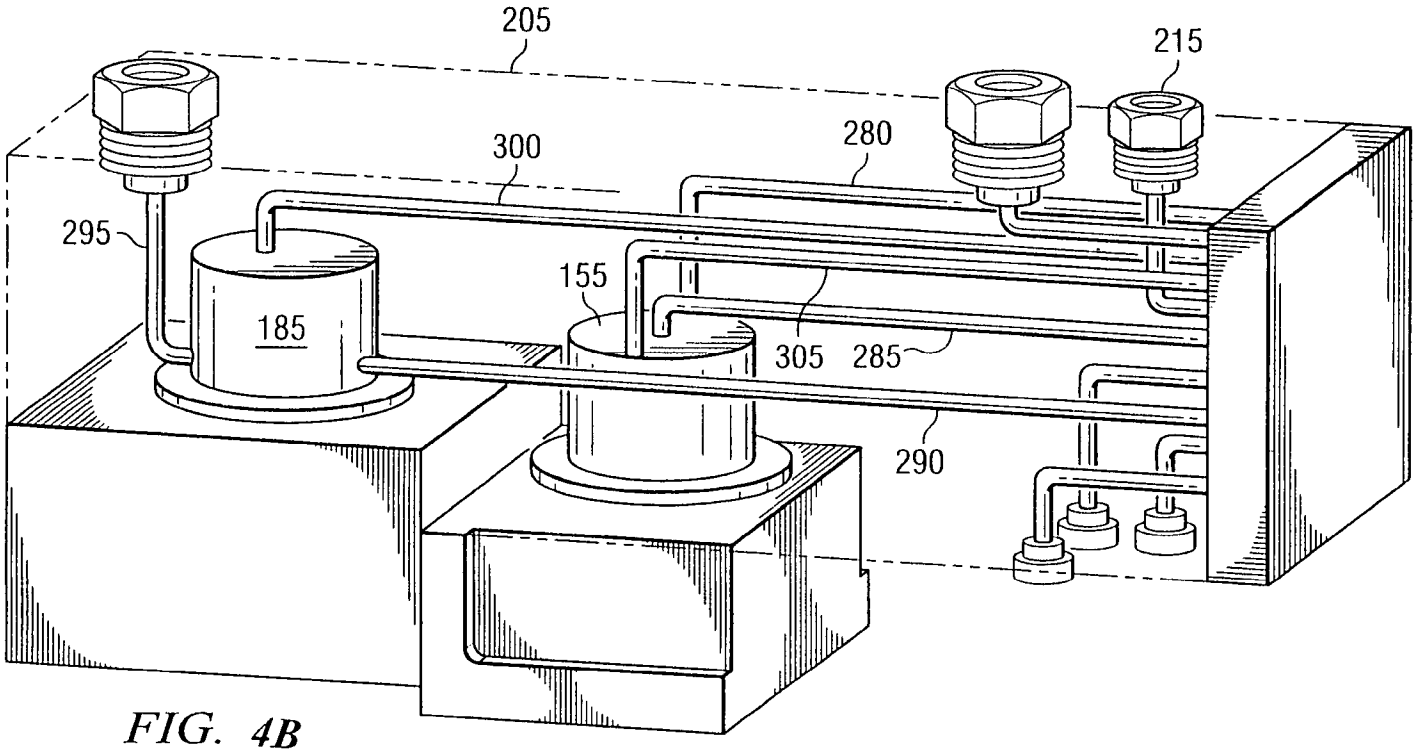
FIG. 4B is a diagrammatic representation of one embodiment of a dispense block.

Dispense block 205 can include various external inlets and outlets including, for example, inlet 210 through which the fluid is received, vent outlet 215 for venting fluid during the vent segment, and dispense outlet 220 through which fluid is dispensed during the dispense segment. Dispense block 205, in the example of FIG. 3A, does not include an external purge outlet as purged fluid is routed back to the feed chamber (as shown in FIG. 4A and FIG. 4B). In other embodiments of the present invention, however, fluid can be purged externally. U.S. Provisional Patent Application No. 60/741,667, entitled "O-Ring-Less Low Profile Fitting and Assembly Thereof" by Iraj Gashgaee, filed Dec. 2, 2005, which is hereby fully incorporated by reference herein, describes an embodiment of fittings that can be utilized to connect the external inlets and outlets of dispense block 205 to fluid lines.

Dispense block 205 routes fluid to the feed pump, dispense pump and filter 120. A pump cover 225 can protect feed motor 175 and dispense motor 200 from damage, while piston housing 227 can provide protection for piston 165 and piston 192 and, according to one embodiment of the present invention, be formed of polyethylene or other polymer. Valve plate 230 provides a valve housing for a system of valves (e.g., inlet valve 125, isolation valve 130, barrier valve 135, purge valve 140 and vent valve 145 of FIG. 2) that can be configured to direct fluid flow to various components of multi-stage pump 100. According to one embodiment, each of inlet valve 125, isolation valve 130, barrier valve 135, purge valve 140 and vent valve 145 is at least partially integrated into valve plate 230 and is a diaphragm valve that is either opened or closed depending on whether pressure or vacuum is applied to the corresponding diaphragm. In other embodiments, some of the valves may be external to dispense block 205 or arranged in additional valve plates. According to one embodiment, a sheet of PTFE is sandwiched between valve plate 230 and dispense block 205 to form the diaphragms of the various valves. Valve plate 230 includes a valve control inlet for each valve to apply pressure or vacuum to the corresponding diaphragm. For example, inlet 235 corresponds to barrier valve 135, inlet 240 to purge valve 140, inlet 245 to isolation valve 130, inlet 250 to vent valve 145, and inlet 255 to inlet valve 125 (outlet valve 147 is external in this case). By the selective application of pressure or vacuum to the inlets, the corresponding valves are opened and closed.

A valve control gas and vacuum are provided to valve plate 230 via valve control supply lines 260, which run from a valve control manifold (in an area beneath top cover 263 or housing cover 225), through dispense block 205 to valve plate 230. Valve control gas supply inlet 265 provides a pressurized gas to the valve control manifold and vacuum inlet 270 provides vacuum (or low pressure) to the valve control manifold. The valve control manifold acts as a three way valve to route pressurized gas or vacuum to the appropriate inlets of valve plate 230 via supply lines 260 to actuate the corresponding valve(s). In one embodiment, a valve plate such as that described in U.S. patent application Ser. No. 11/602,457, entitled "Fixed Volume Valve System", by Gashgaee et al., filed Nov. 20, 2006 herein incorporated by reference in its entirety, can be used that reduces the hold-up volume of the valve, eliminates volume variations due to vacuum fluctuations, reduces vacuum requirements and reduces stress on the valve diaphragm.

Figure 3B:
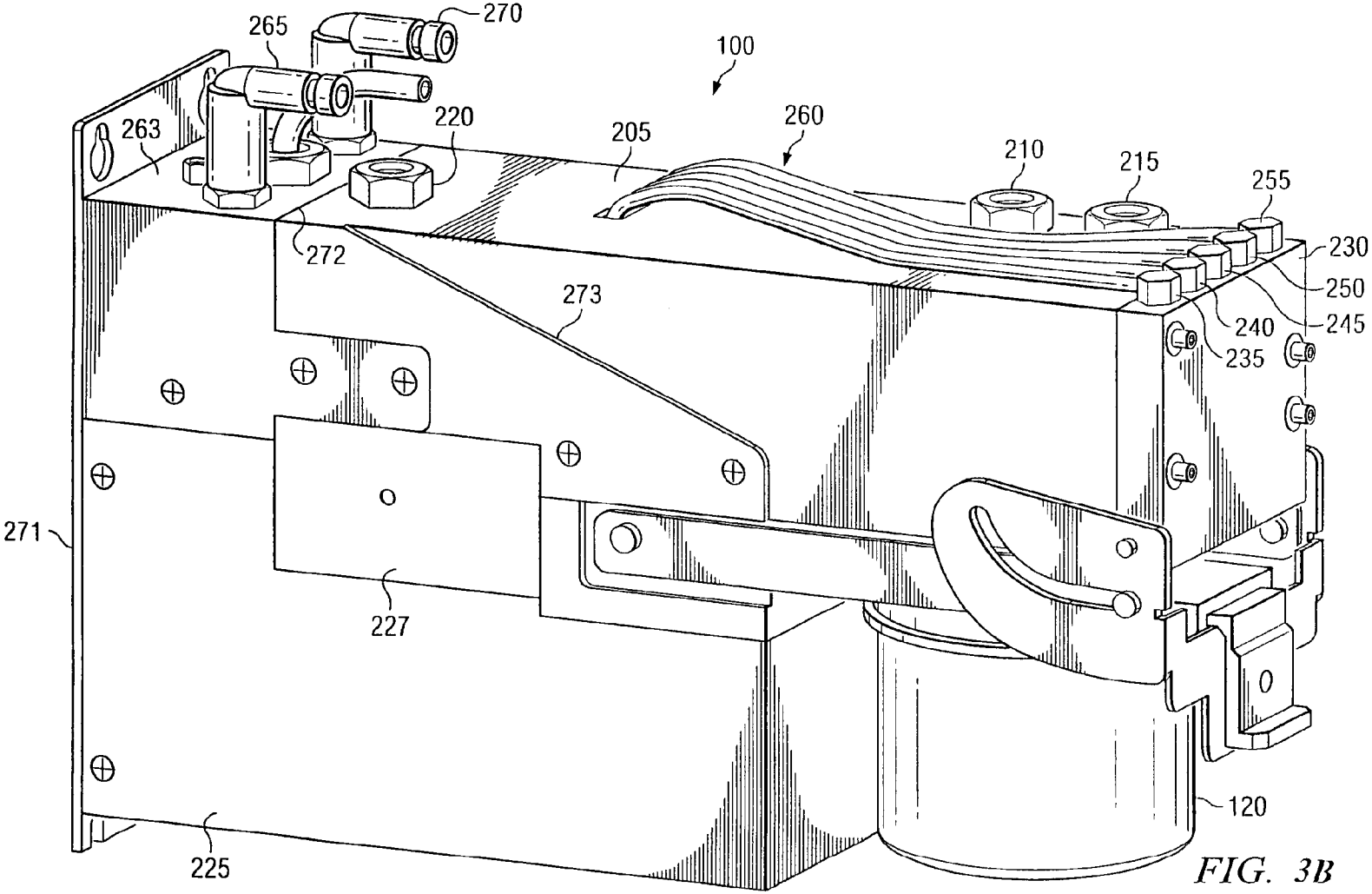

FIG. 3B is a diagrammatic representation of another embodiment of multistage pump 100. Many of the features shown in FIG. 3B are similar to those described in conjunction with FIG. 3A above. However, the embodiment of FIG. 3B includes several features to prevent fluid drips from entering the area of multi-stage pump 100 housing electronics. Fluid drips can occur, for example, when an operator connects or disconnects a tube from inlet 210, outlet 215 or vent 220. The "drip-proof" features are designed to prevent drips of potentially harmful chemicals from entering the pump, particularly the electronics chamber and do not necessarily require that the pump be "water-proof" (e.g., submersible in fluid without leakage). According to other embodiments, the pump can be fully sealed.

According to one embodiment, dispense block 205 can include a vertically protruding flange or lip 272 protruding outward from the edge of dispense block 205 that meets top cover 263. On the top edge, according to one embodiment, the top of top cover 263 is flush with the top surface of lip 272. This causes drips near the top interface of dispense block 205 and top cover 263 to tend to run onto dispense block 205, rather than through the interface. On the sides, however, top cover 263 is flush with the base of lip 272 or otherwise inwardly offset from the outer surface of lip 272. This causes drips to tend to flow down the corner created by top cover 263 and lip 272, rather than between top cover 263 and dispense block 205. Additionally, a rubber seal is placed between the top edge of top cover 263 and back plate 271 to prevent drips from leaking between top cover 263 and back plate 271.

Dispense block 205 can also include sloped feature 273 that includes a sloped surface defined in dispense block 205 that slopes down and away from the area of pump 100 housing electronics. Consequently, drips near the top of dispense block 205 are lead away from the electronics. Additionally, pump cover 225 can also be offset slightly inwards from the outer side edges of dispense block 205 so that drips down the side of pump 100 will tend to flow past the interface of pump cover 225 and other portions of pump 100.

According to one embodiment of the present invention, wherever a metal cover interfaces with dispense block 205, the vertical surfaces of the metal cover can be slightly inwardly offset (e.g., 1/64 of an inch or 0.396875 millimeters) from the corresponding vertical surface of dispense block 205. Additionally, multi-stage pump 100 can include seals, sloped features and other features to prevent drips from entering portions of multi-stage pump 100 housing electronics. Furthermore, as shown in FIG. 4A, discussed below, back plate 271 can include features to further "drip-proof" multi-stage pump 100.

FIG. 4A is a diagrammatic representation of one embodiment of multi-stage pump 100 with dispense block 205 made transparent to show the fluid flow passages defined there through. Dispense block 205 defines various chambers and fluid flow passages for multi-stage pump 100. According to one embodiment, feed chamber 155 and dispense chamber 185 can be machined directly into dispense block 205. Additionally, various flow passages can be machined into dispense block 205. Fluid flow passage 275 (shown in FIG. 5C) runs from inlet 210 to the inlet valve. Fluid flow passage 280 runs from the inlet valve to feed chamber 155, to complete the path from inlet 210 to feed pump 150. Inlet valve 125 in valve housing 230 regulates flow between inlet 210 and feed pump 150. Flow passage 285 routes fluid from feed pump 150 to isolation valve 130 in valve plate 230. The output of isolation valve 130 is routed to filter 120 by another flow passage (not shown). Fluid flows from filter 120 through flow passages that connect filter 120 to the vent valve 145 and barrier valve 135. The output of vent valve 145 is routed to vent outlet 215 while the output of barrier valve 135 is routed to dispense pump 180 via flow passage 290. Dispense pump, during the dispense segment, can output fluid to outlet 220 via flow passage 295 or, in the purge segment, to the purge valve through flow passage 300. During the purge segment, fluid can be returned to feed pump 150 through flow passage 305. Because the fluid flow passages can be formed directly in the PTFE (or other material) block, dispense block 205 can act as the piping for the process fluid between various components of multi-stage pump 100, obviating or reducing the need for additional tubing. In other cases, tubing can be inserted into dispense block 205 to define the fluid flow passages. FIG. 4B provides a diagrammatic representation of dispense block 205 made transparent to show several of the flow passages therein, according to one embodiment.

Returning to FIG. 4A, FIG. 4A also shows multi-stage pump 100 with pump cover 225 and top cover 263 removed to show feed pump 150, including feed stage motor 190, dispense pump 180, including dispense motor 200, and valve control manifold 302. According to one embodiment of the present invention, portions of feed pump 150, dispense pump 180 and valve plate 230 can be coupled to dispense block 205 using bars (e.g., metal bars) inserted into corresponding cavities in dispense block 205. Each bar can include on or more threaded holes to receive a screw. As an example, dispense motor 200 and piston housing 227 can be mounted to dispense block 205 via one or more screws (e.g., screw 275 and screw 280) that run through screw holes in dispense block 205 to thread into corresponding holes in bar 285. It should be noted that this mechanism for coupling components to dispense block 205 is provided by way of example and any suitable attachment mechanism can be used.

Back plate 271, according to one embodiment of the present invention, can include inwardly extending tabs (e.g., bracket 274) to which top cover 263 and pump cover 225 mount. Because top cover 263 and pump cover 225 overlap bracket 274 (e.g., at the bottom and back edges of top cover 263 and the top and back edges pump cover 225) drips are prevented from flowing into the electronics area between any space between the bottom edge of top cover 263 and the top edge of pump cover 225 or at the back edges of top cover 263 and pump cover 225.

Manifold 302, according to one embodiment of the present invention can include a set of solenoid valves to selectively direct pressure/vacuum to valve plate 230. When a particular solenoid is on thereby directing vacuum or pressure to a valve, depending on implementation, the solenoid will generate heat. According to one embodiment, manifold 302 is mounted below a PCB board (which is mounted to back plate 271 and better shown in FIG. 4C) away from dispense block 205 and particularly dispense chamber 185. Manifold 302 can be mounted to a bracket that is, in turn, mounted to back plate 271 or can be coupled otherwise to back plate 271. This helps prevent heat from the solenoids in manifold 302 from affecting fluid in dispense block 205. Back plate 271 can be made of stainless steel, machined aluminum or other material that can dissipate heat from manifold 302 and the PCB. Put another way, back plate 271 can act as a heat dissipating bracket for manifold 302 and the PCB. Pump 100 can be further mounted to a surface or other structure to which heat can be conducted by back plate 271. Thus, back plate 271 and the structure to which it is attached act as a heat sink for manifold 302 and the electronics of pump 100.

Figure 4C:
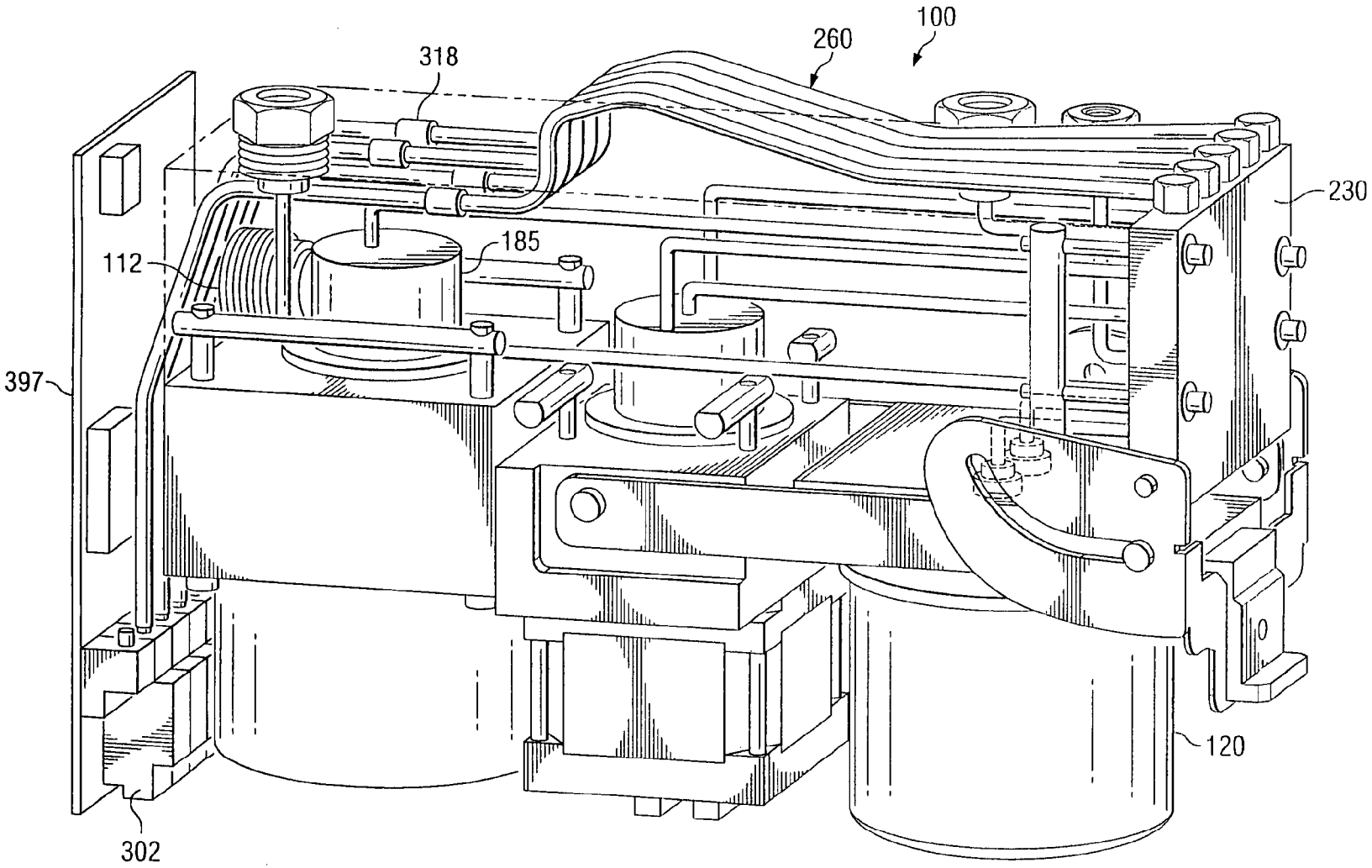

FIG. 4C is a diagrammatic representation of multi-stage pump 100 showing supply lines 260 for providing pressure or vacuum to valve plate 230. As discussed in conjunction with FIG. 3, the valves in valve plate 230 can be configured to allow fluid to flow to various components of multi-stage pump 100. Actuation of the valves is controlled by the valve control manifold 302 that directs either pressure or vacuum to each supply line 260. Each supply line 260 can include a fitting (an example fitting is indicated at 318) with a small orifice. This orifice may be of a smaller diameter than the diameter of the corresponding supply line 260 to which fitting 318 is attached. In one embodiment, the orifice may be approximately 0.010 inches in diameter. Thus, the orifice of fitting 318 may serve to place a restriction in supply line 260. The orifice in each supply line 260 helps mitigate the effects of sharp pressure differences between the application of pressure and vacuum to the supply line and thus may smooth transitions between the application of pressure and vacuum to the valve. In other words, the orifice helps reduce the impact of pressure changes on the diaphragm of the downstream valve. This allows the valve to open and close more smoothly and more slowly which may lead to increased to smoother pressure transitions within the system which may be caused by the opening and closing of the valve and may in fact increase the longevity of the valve itself.

Figure 4D:
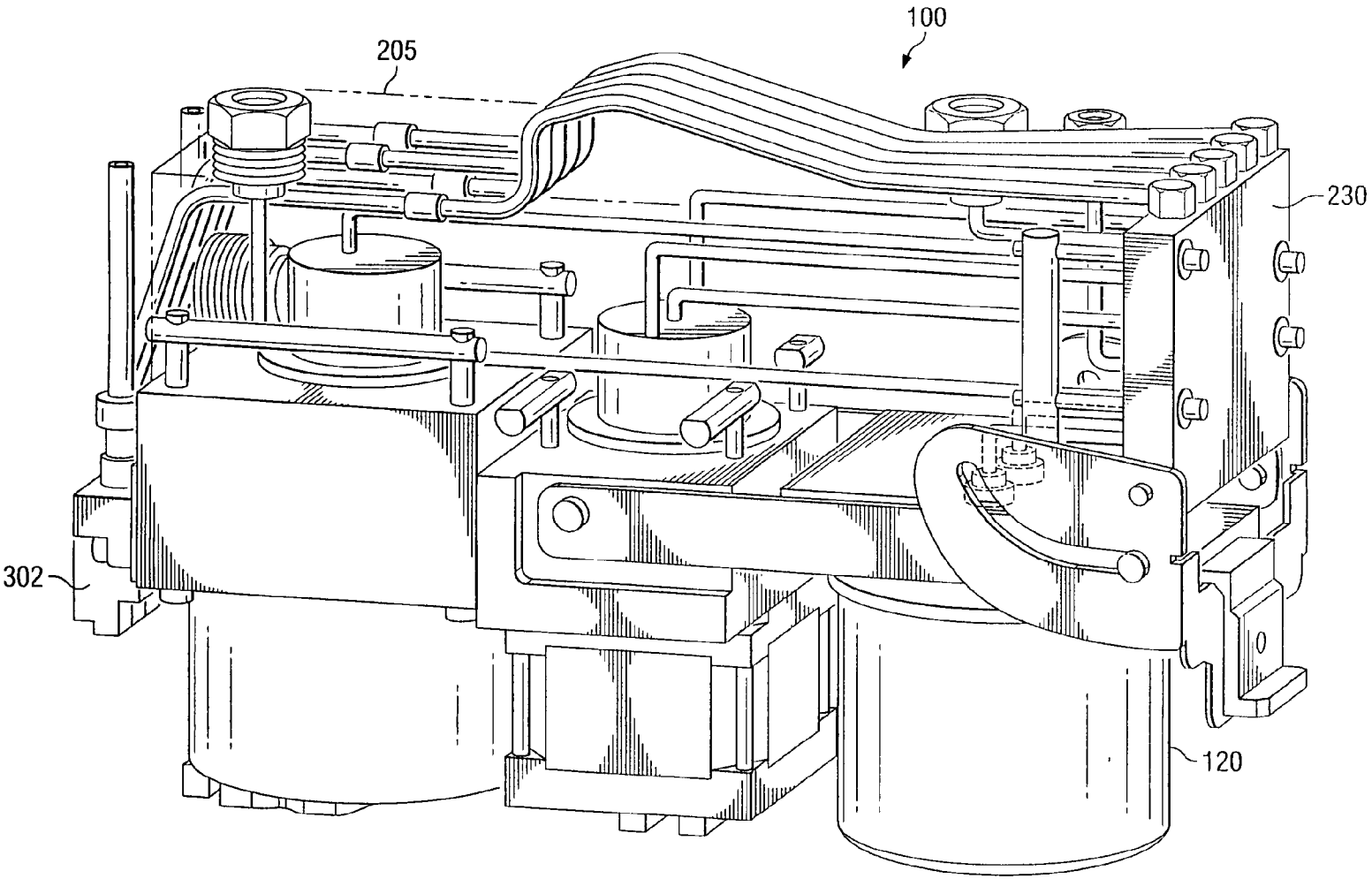

FIG. 4C also illustrates PCB 397 to which manifold 302 can be coupled. Manifold 302, according to one embodiment of the present invention, can receive signals from PCB board 397 to cause solenoids to open/close to direct vacuum/pressure to the various supply lines 260 to control the valves of multi-stage pump 100. Again, as shown in FIG. 4C, manifold 302 can be located at the distal end of PCB 397 from dispense block 205 to reduce the affects of heat on the fluid in dispense block 205. Additionally, to the extent feasible based on PCB design and space constraints, components that generate heat can be placed on the side of PCB away from dispense block 205, again reducing the affects of heat. Heat from manifold 302 and PCB 397 can be dissipated by back plate 271. FIG. 4D, on the other hand, is a diagrammatic representation of an embodiment of pump 100 in which manifold 302 is mounted directly to dispense block 205.

It may now be useful to describe the operation of multi-stage pump 100. During operation of multi-stage pump 100, the valves of multi-stage pump 100 are opened or closed to allow or restrict fluid flow to various portions of multi-stage pump 100. According to one embodiment, these valves can be pneumatically actuated (i.e., gas driven) diaphragm valves that open or close depending on whether pressure or a vacuum is asserted. However, in other embodiments of the present invention, any suitable valve can be used.

The following provides a summary of various stages of operation of multi-stage pump 100. However, multi-stage pump 100 can be controlled according to a variety of control schemes including, but not limited to those described in U.S. patent application Ser. No. 11/502,729 entitled "Systems And Methods For Fluid Flow Control In An Immersion Lithography System" by Michael Clarke, Robert F. McLoughlin and Marc Layerdiere, filed Aug. 11, 2006, each of which is fully incorporated by reference herein, to sequence valves and control pressure. According to one embodiment, multi-stage pump 100 can include a ready segment, dispense segment, fill segment, pre-filtration segment, filtration segment, vent segment, purge segment and static purge segment. During the feed segment, inlet valve 125 is opened and feed stage pump 150 moves (e.g., pulls) feed stage diaphragm 160 to draw fluid into feed chamber 155. Once a sufficient amount of fluid has filled feed chamber 155, inlet valve 125 is closed. During the filtration segment, feed-stage pump 150 moves feed stage diaphragm 160 to displace fluid from feed chamber 155. Isolation valve 130 and barrier valve 135 are opened to allow fluid to flow through filter 120 to dispense chamber 185. Isolation valve 130, according to one embodiment, can be opened first (e.g., in the "pre-filtration segment") to allow pressure to build in filter 120 and then barrier valve 135 opened to allow fluid flow into dispense chamber 185. According to other embodiments, both isolation valve 130 and barrier valve 135 can be opened and the feed pump moved to build pressure on the dispense side of the filter. During the filtration segment, dispense pump 180 can be brought to its home position. As described in U.S. Provisional Patent Application No. 60/630,384, entitled "System and Method for a Variable Home Position Dispense System" by Layerdiere, et al. filed Nov. 23, 2004 and PCT Application No. PCT/US2005/042127, entitled "System and Method for Variable Home Position Dispense System", by Layerdiere et al., filed Nov. 21, 2005, each of which is incorporated here by reference, the home position of the dispense pump can be a position that gives the greatest available volume at the dispense pump for the dispense cycle, but is less than the maximum available volume that the dispense pump could provide. The home position is selected based on various parameters for the dispense cycle to reduce unused hold up volume of multi-stage pump 100. Feed pump 150 can similarly be brought to a home position that provides a volume that is less than its maximum available volume.

At the beginning of the vent segment, isolation valve 130 is opened, barrier valve 135 closed and vent valve 145 opened. In another embodiment, barrier valve 135 can remain open during the vent segment and close at the end of the vent segment. During this time, if barrier valve 135 is open, the pressure can be understood by the controller because the pressure in the dispense chamber, which can be measured by pressure sensor 112, will be affected by the pressure in filter 120. Feed-stage pump 150 applies pressure to the fluid to remove air bubbles from filter 120 through open vent valve 145. Feed-stage pump 150 can be controlled to cause venting to occur at a predefined rate, allowing for longer vent times and lower vent rates, thereby allowing for accurate control of the amount of vent waste. If feed pump is a pneumatic style pump, a fluid flow restriction can be placed in the vent fluid path, and the pneumatic pressure applied to feed pump can be increased or decreased in order to maintain a "venting" set point pressure, giving some control of an other wise uncontrolled method.

At the beginning of the purge segment, isolation valve 130 is closed, barrier valve 135, if it is open in the vent segment, is closed, vent valve 145 closed, and purge valve 140 opened and inlet valve 125 opened. Dispense pump 180 applies pressure to the fluid in dispense chamber 185 to vent air bubbles through purge valve 140. During the static purge segment, dispense pump 180 is stopped, but purge valve 140 remains open to continue to vent air. Any excess fluid removed during the purge or static purge segments can be routed out of multi-stage pump 100 (e.g., returned to the fluid source or discarded) or recycled to feed-stage pump 150. During the ready segment, inlet valve 125, isolation valve 130 and barrier valve 135 can be opened and purge valve 140 closed so that feed-stage pump 150 can reach ambient pressure of the source (e.g., the source bottle). According to other embodiments, all the valves can be closed at the ready segment.

During the dispense segment, outlet valve 147 opens and dispense pump 180 applies pressure to the fluid in dispense chamber 185. Because outlet valve 147 may react to controls more slowly than dispense pump 180, outlet valve 147 can be opened first and some predetermined period of time later dispense motor 200 started. This prevents dispense pump 180 from pushing fluid through a partially opened outlet valve 147. Moreover, this prevents fluid moving up the dispense nozzle caused by the valve opening, followed by forward fluid motion caused by motor action. In other embodiments, outlet valve 147 can be opened and dispense begun by dispense pump 180 simultaneously.

An additional suckback segment can be performed in which excess fluid in the dispense nozzle is removed. During the suckback segment, outlet valve 147 can close and a secondary motor or vacuum can be used to suck excess fluid out of the outlet nozzle. Alternatively, outlet valve 147 can remain open and dispense motor 200 can be reversed to such fluid back into the dispense chamber. The suckback segment helps prevent dripping of excess fluid onto the wafer.

Figure 5:
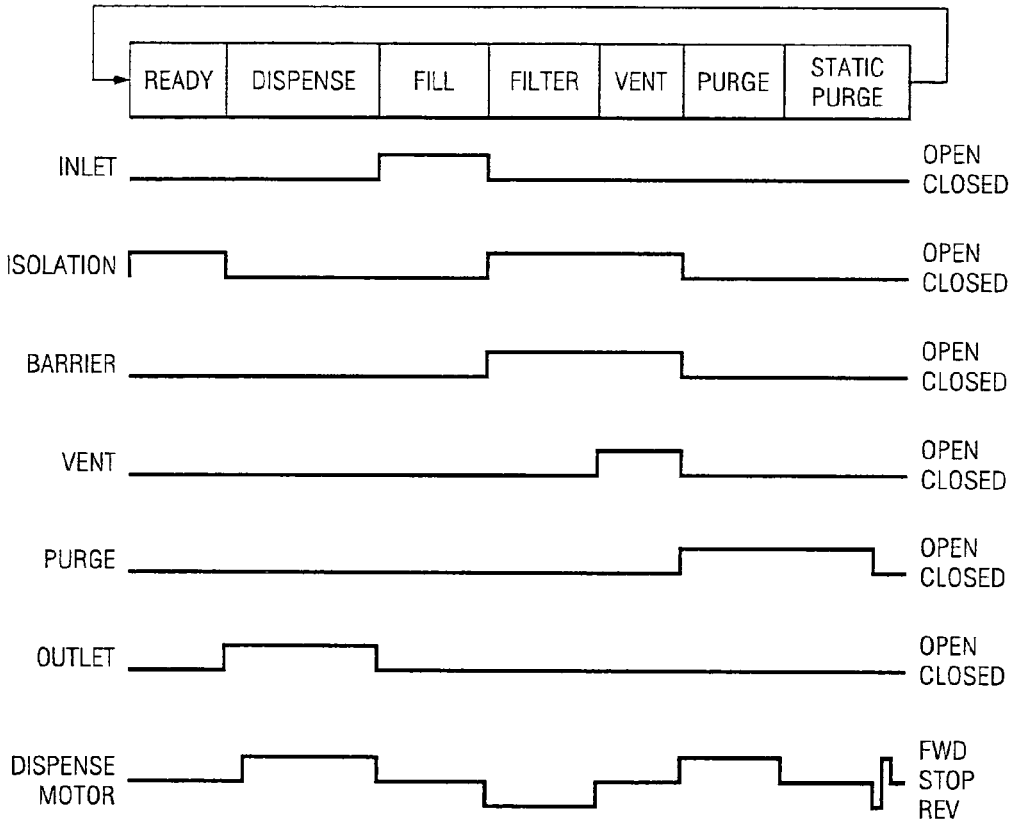
FIG. 5 is a diagrammatic representation of valve and motor timings for one embodiment of the present invention.

Referring briefly to FIG. 5, this figure provides a diagrammatic representation of valve and dispense motor timings for various segments of the operation of multi-stage pump 100 of FIG. 2. While several valves are shown as closing simultaneously during segment changes, the closing of valves can be timed slightly apart (e.g., 100 milliseconds) to reduce pressure spikes. For example, between the vent and purge segment, isolation valve 130 can be closed shortly before vent valve 145. It should be noted, however, other valve timings can be utilized in various embodiments of the present invention. Additionally, several of the segments can be performed together (e.g., the fill/dispense stages can be performed at the same time, in which case both the inlet and outlet valves can be open in the dispense/fill segment). It should be further noted that specific segments do not have to be repeated for each cycle. For example, the purge and static purge segments may not be performed every cycle. Similarly, the vent segment may not be performed every cycle.

The opening and closing of various valves can cause pressure spikes in the fluid within multi-stage pump 100. Because outlet valve 147 is closed during the static purge segment, closing of purge valve 140 at the end of the static purge segment, for example, can cause a pressure increase in dispense chamber 185. This can occur because each valve may displace a small volume of fluid when it closes. More particularly, in many cases before a fluid is dispensed from chamber 185 a purge cycle and/or a static purge cycle is used to purge air from dispense chamber 185 in order to prevent sputtering or other perturbations in the dispense of the fluid from multi-stage pump 100. At the end of the static purge cycle, however, purge valve 140 closes in order to seal dispense chamber 185 in preparation for the start of the dispense. As purge valve 140 closes it forces a volume of extra fluid (approximately equal to the hold-up volume of purge valve 140) into dispense chamber 185, which, in turn, causes an increase in pressure of the fluid in dispense chamber 185 above the baseline pressure intended for the dispense of the fluid. This excess pressure (above the baseline) may cause problems with a subsequent dispense of fluid. These problems are exacerbated in low pressure applications, as the pressure increase caused by the closing of purge valve 140 may be a greater percentage of the baseline pressure desirable for dispense.

More specifically, because of the pressure increase that occurs due to the closing of purge valve 140 a "spitting" of fluid onto the wafer, a double dispense or other undesirable fluid dynamics may occur during the subsequent dispense segment if the pressure is not reduced. Additionally, as this pressure increase may not be constant during operation of multi-stage pump 100, these pressure increases may cause variations in the amount of fluid dispensed, or other characteristics of the dispense, during successive dispense segments. These variations in the dispense may in turn cause an increase in wafer scrap and rework of wafers. Embodiments of the present invention account for the pressure increase due to various valve closings within the system to achieve a desirable starting pressure for the beginning of the dispense segment, account for differing head pressures and other differences in equipment from system to system by allowing almost any baseline pressure to be achieved in dispense chamber 185 before a dispense.

In one embodiment, to account for unwanted pressure increases to the fluid in dispense chamber 185, during the static purge segment dispense motor 200 may be reversed to back out piston 192 a predetermined distance to compensate for any pressure increase caused by the closure of barrier valve 135, purge valve 140 and/or any other sources which may cause a pressure increase in dispense chamber 185. The pressure in dispense chamber 185 may be controlled by regulating the speed of feed pump 150 as described in U.S. patent application Ser. No. 11/292,559, entitled "System and Method for Control of Fluid Pressure," by George Gonnella and James Cedrone, filed Dec. 2, 2005, and U.S. patent application Ser. No. 11/364,286, entitled "System And Method For Monitoring Operation Of A Pump", by George Gonnella and James Cedrone, filed Feb. 28, 2006, incorporated herein.

Thus, embodiments of the present invention provide a multi-stage pump with gentle fluid handling characteristics. By compensating for pressure fluctuations in a dispense chamber before a dispense segment, potentially damaging pressure spikes can be avoided or mitigated. Embodiments of the present invention can also employ other pump control mechanisms and valve timings to help reduce deleterious effects of pressure and pressure variations on a process fluid.

To that end, attention is now directed to systems and methods for maintaining substantially a baseline pressure in a chamber of a pumping apparatus. Embodiments of the present invention may serve to control a motor to compensate or account for a pressure drift which may occur in a chamber of the pumping apparatus. More specifically, a dispense motor may be controlled to substantially maintain a baseline pressure in the dispense chamber before a dispense based on a pressure sensed in the dispense chamber. In one embodiment, before a dispense is initiated a control loop may be utilized such that it is repeatedly determined if the pressure in the dispense chamber is above (or below) a desired pressure and, if so, the movement of the pumping means regulated to maintain substantially the desired pressure in the dispense chamber until a dispense of fluid is initiated.

Figure 6:
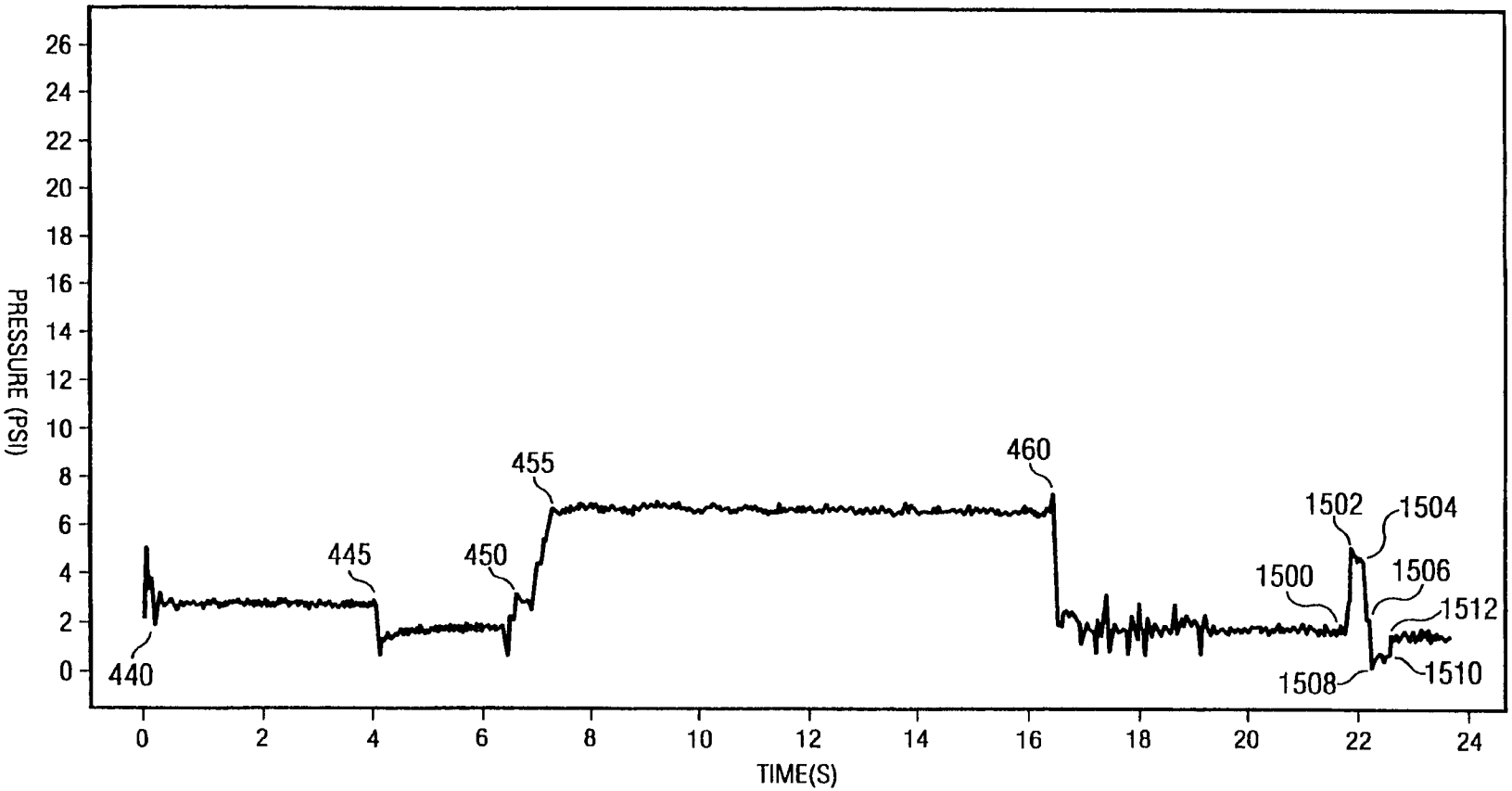
FIG. 6 is an example pressure profile of an embodiment of an actuation sequence used with a pump.

The reduction of these variations in pressure may be better understood with reference to FIG. 6 which illustrates an example pressure profile at dispense chamber 185 for operating a multi-stage pump according to one embodiment of the present invention. At point 440, a dispense is begun and dispense pump 180 pushes fluid out the outlet. The dispense ends at point 445. The pressure at dispense chamber 185 remains fairly constant during the fill stage as dispense pump 180 is not typically involved in this stage. At point 450, the filtration stage begins and feed stage motor 175 goes forward at a predefined rate to push fluid from feed chamber 155. As can be seen in FIG. 6, the pressure in dispense chamber 185 begins to rise to reach a predefined set point at point 455. When the pressure in dispense chamber 185 reaches the set point, dispense motor 200 reverses at a constant rate to increase the available volume in dispense chamber 185. In the relatively flat portion of the pressure profile between point 455 and point 460, the speed of feed motor 175 is increased whenever the pressure drops below the set point and decreased when the set point is reached. This keeps the pressure in dispense chamber 185 at an approximately constant pressure. At point 460, dispense motor 200 reaches its home position and the filtration stage ends. The sharp pressure spike at point 460 is caused by the closing of barrier valve 135 at the end of filtration.

After the vent and purge segments and before the end of the static purge segment, purge valve 140 is closed, causing the spike in the pressure starting at point 1500 in the pressure profile. As can be seen between points 1500 and 1502 of the pressure profile the pressure in dispense chamber 185 may undergo a marked increase due to this closure. The increase in pressure due to closure of purge valve 140 is usually not consistent, and depends on the temperature of the system and the viscosity of the fluid being utilized with multi-stage pump 100.

To account for the pressure increase occurring between points 1500 and 1502, dispense motor 200 may be reversed to back out piston 192 a predetermined distance to compensate for any pressure increase caused by the closure of barrier valve 135, purge valve 140 and/or any other sources. In some cases, as purge valve 140 may take some amount of time to close it may be desirable to delay a certain amount of time before reversing dispense motor 200. Thus, the time between points 1500 and 1504 on the pressure profile reflects the delay between the signal to close purge valve 140 and the reversal of dispense motor 200. This time delay may be adequate to allow purge valve 140 to completely close, and the pressure within dispense chamber 185 to substantially settle, which may be around 50 milliseconds.

As the hold-up volume of purge valve 140 may be a known quantity (e.g. within manufacturing tolerances), the dispense motor 200 may be reversed to back out piston 192*a* compensation distance to increase the volume of dispense chamber 185 approximately equal to the hold-up volume of purge valve 140. As the dimensions of dispense chamber 185 and piston 192 are also known quantities, dispense motor 200 may be reversed a particular number of motor increments, wherein by reversing dispense motor 200 by this number of motor increments the volume of dispense chamber 185 is increased by approximately the hold-up volume of purge valve 140.

The effects of backing out piston 192 via the reversal of dispense motor 200 cause a decrease in pressure in dispense chamber 185 from point 1504 to approximately a baseline pressure desired for dispense at point 1506. In many cases, this pressure correction may be adequate to obtain a satisfactory dispense in a subsequent dispense stage. Depending on the type of motor being utilized for dispense motor 200 or the type of valve being utilized for purge valve 140, however, reversing dispense motor 200 to increase the volume of dispense chamber 185 may create a space or "backlash" in the drive mechanism of dispense motor 200. This "backlash" may mean that when dispense motor 200 is activated in a forward direction to push fluid out dispense pump 180 during the dispense segment there may be certain amount of slack or space between components of the dispense motor 200, such as the motor nut assembly, which may have to be taken up before the drive assembly of dispense motor 200 physically engages such that piston 192 moves. As the amount of this backlash may be variable it may be difficult to account for this backlash when determining how far forward to move piston 192 to obtain a desired dispense pressure. Thus, this backlash in the drive assembly of dispense motor 200 may cause variability in the amount of fluid dispensed during each dispense segment.

Consequently, it may be desirable to ensure that the last motion of dispense motor 200 is in a forward direction before a dispense segment so as to reduce the amount of backlash in the drive assembly of dispense motor 200 to a substantially negligible or non-existent level. Therefore, in some embodiments, to account for unwanted backlash in the drive motor assembly of dispense pump 200, dispense motor 200 may be reversed to back out piston 192 a predetermined distance to compensate for any pressure increase caused by the closure of barrier valve 135, purge valve 140 and/or any other sources which may cause a pressure increase in dispense chamber 185 and additionally dispense motor may be reversed to back out piston 192 an additional overshoot distance to add an overshot volume to dispense chamber 185. Dispense motor 200 may then be engaged in a forward direction to move piston 192 in a forward direction substantially equal to the overshoot distance. This results in approximately the desired baseline pressure in dispense chamber 185 while also ensuring that the last motion of dispense motor 200 before dispense is in a forward direction, substantially removing any backlash from the drive assembly of dispense motor 200.

Referring still to FIG. 6, as described above a spike in pressure starting at point 1500 in the pressure profile may be caused by the closing of purge valve 140. To account for the pressure increase occurring between points 1500 and 1502, after a delay dispense motor 200 may be reversed to back out piston 192 a predetermined distance to compensate for any pressure increase caused by the closure of purge valve 140 (and/or any other sources) plus an additional overshoot distance. As described above the compensation distance may increase the volume of dispense chamber 185 approximately equal to the hold-up volume of purge valve 140. The overshoot distance may also increase the volume of dispense chamber 185 approximately equal to the hold-up volume of purge valve 140, or a lesser or greater volume depending on the particular implementation.

The effects of backing out piston 192 the compensation distance plus the overshoot distance via the reversal of dispense motor 200 cause a decrease in pressure in dispense chamber 185 from point 1504 to point 1508. Dispense motor 200 may then be engaged in a forward direction to move piston 192 in a forward direction substantially equal to the overshoot distance. In some cases, it may be desirable to allow dispense motor 200 to come to a substantially complete stop before engaging dispense motor 200 in a forward direction; this delay may be around 50 milliseconds. The effects of the forward movement of piston 192 via the forward engagement of dispense motor 200 causes an increase in pressure in dispense chamber 185 from point 1510 to approximately a baseline pressure desired for dispense at point 1512, while ensuring that the last movement of dispense motor 200 before a dispense segment is in a forward direction, removing substantially all backlash from the drive assembly of dispense motor 200. The reversal and forward movement of dispense motor 200 at the end of the static purge segment is depicted in the timing diagram of FIG. 3.

Figure 7:
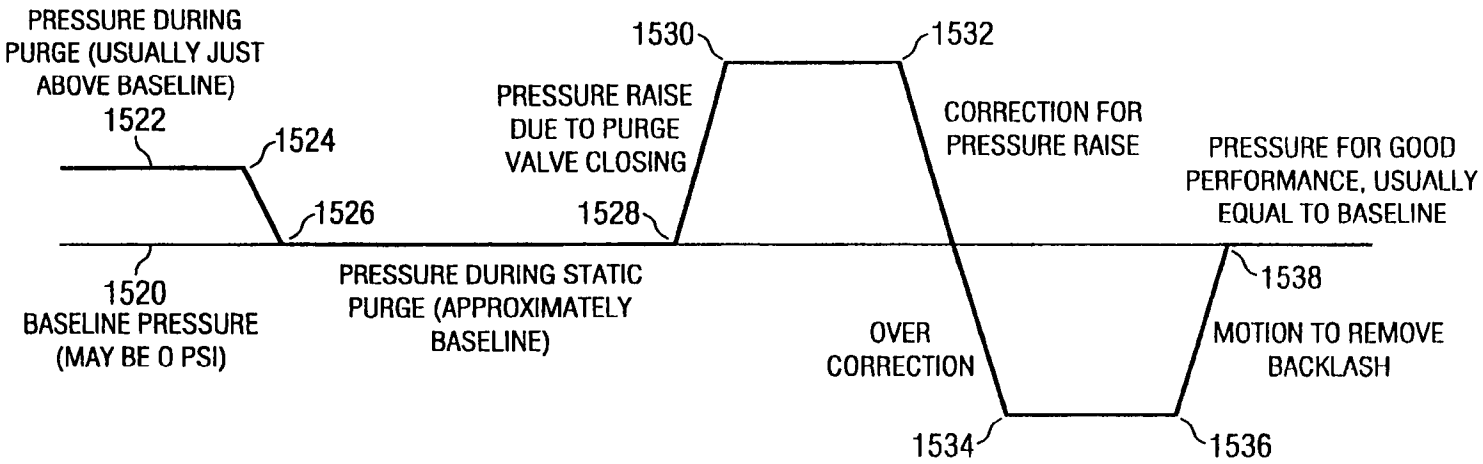
FIG. 7 is an example pressure profile of a portion of an embodiment of an actuation sequence used with a pump.

Embodiments of the invention may be described more clearly with respect to FIG. 7 which illustrates an example pressure profile at dispense chamber 185 during certain segments of operating a multi-stage pump according to one embodiment of the present invention. Line 1520 represents a baseline pressure desired for dispense of fluid, which, although it may be any pressure desired, is typically around 0 p.s.i (e.g. gauge), or the atmospheric pressure. At point 1522, during a purge segment the pressure in dispense chamber 185 may be just above baseline pressure 1520. Dispense motor 200 may be stopped at the end of the purge segment causing the pressure in dispense chamber 185 to fall starting at point 1524 to approximately baseline pressure 1520 at point 1526. Before the end of the static purge segment, however, a valve in pump 100 such as purge valve 140 may be closed, causing the spike in the pressure between points 1528 and 1530 of the pressure profile.

Dispense motor 200 may then be reversed to move piston 192 a compensation distance and an overshoot distance (as described above) causing the pressure in dispense chamber 185 to fall below baseline pressure 1520 between points 1532 and 1534 of the pressure profile. To return the pressure in dispense chamber 185 to approximately baseline pressure 1520 and to remove backlash from the drive assembly of dispense motor 200, dispense motor 200 may be engaged in a forward direction substantially equal to the overshoot distance. This movement causes the pressure in dispense chamber 185 to return to baseline pressure 1520 between points 1536 and 1538 of the pressure profile. Thus, the pressure in dispense chamber 185 is returned substantially to a baseline pressure desired for dispense, backlash is removed from the drive assembly of dispense motor 200, and a desirable dispense may be achieved during a succeeding dispense segment.

Though the above embodiments of the invention have been mainly described in conjunction with correcting for pressure increases caused by the closing of a purge valve during a static purge segment it will be apparent that these same techniques may be applied to correct for pressure increases or decreases caused by almost any source, whether internal or external to multi-stage pump 100, during any stage of operation of multi-stage pump 100, and may be especially useful for correcting for pressure variations in dispense chamber 185 caused by the opening or closure of valves in the flow path to or from dispense chamber 185.

Additionally, it will be apparent that these same techniques may be used to achieve a desired baseline pressure in dispense chamber 185 by compensating for variation in other equipment used in conjunction with multi-stage pump 100. In order to better compensate for these differences in equipment or other variations in processes, circumstances or equipment used internally or externally to multi-stage pump 100, certain aspects or variables of the invention such as the baseline pressure desired in dispense chamber 185, the compensation distance, the overshoot distance, delay time etc. may be configurable by a user of pump 100.

Furthermore, embodiments of the present invention may similarly achieve a desired baseline pressure in dispense chamber 185 utilizing pressure transducer 112. For example, to compensate for any pressure increase caused by the closure of purge valve 140 (and/or any other sources) piston 192 may be backed out (or moved forward) until a desired baseline pressure in dispense chamber 185 (as measured by pressure transducer 112) is achieved. Similarly, to reduce the amount of backlash in the drive assembly of dispense motor 200 to a substantially negligible or non-existent level before a dispense piston 193 may be backed out until the pressure in dispense chamber 185 is below a baseline pressure and then engaged in the forward direction until the pressure in dispense chamber 185 comes up to the baseline pressure desired for dispense.

Not only may pressure variations in the fluid be accounted for as described above, but in addition, pressure spikes in the process fluid, or other pressure fluctuations, can also be reduced by avoiding closing valves to create entrapped spaces and opening valves between entrapped spaces. During a complete dispense cycle of multi-stage pump 100 (e.g. from dispense segment to dispense segment) valves within multi-stage pump 100 may change states many time. During these myriad changes unwanted pressure spikes and drops can occur. Not only can these pressure fluctuations cause damage to sensitive process chemicals but, in addition, the opening and closing of these valves can cause disruptions or variations in the dispense of fluid. For example, a sudden pressure increase in hold-up volume caused by the opening of one or more interior valves coupled to dispense chamber 185 may cause a corresponding drop in pressure in the fluid within dispense chamber 185 and may cause bubbles to form in the fluid, which in turn may affect a subsequent dispense.

In order to ameliorate the pressure variations caused by the opening and closing of the various valves within multi-stage pump 100, the opening and closing of the various valves and/or engagement and disengagement of the motors can be timed to reduce these pressure spikes. In general, to reduce pressure variations according to embodiments of the present invention a valve will never be closed to create a closed or entrapped space in the fluid path if it can be avoided, and part and parcel with this, a valve between two entrapped spaces will not be opened if it can be avoided. Conversely, opening any valve should be avoided unless there is an open fluid path to an area external to multi-stage pump 100 or an open fluid path to atmosphere or conditions external to multi-stage pump 100 (e.g. outlet valve 147, vent valve 145 or inlet valve 125 is open).

Another way to express the general guidelines for the opening and closing of valves within multi-stage pump 100 according to embodiments of the present invention is that during operation of multi-stage pump 100, interior valves in multi-stage pump 100, such as barrier valve 135 or purge valve 140 will be opened or closed only when an exterior valve such as inlet valve 125, vent valve 145 or outlet valve 147 is open in order to exhaust any pressure change caused by the change in volume (approximately equal to the hold-up volume of the interior valve to be opened) which may result from an opening of a valve. These guidelines may be thought of in yet another manner, when opening valves within multi-stage pump 100, valves should be opened from the outside in (i.e. outside valves should be opened before inside valves) while when closing valves within multi-stage pump 100 valves should be closed from the inside out (i.e. inside valves should be closed before outside valves).

Additionally, in some embodiments, a sufficient amount of time will be utilized between certain changes to ensure that a particular valve is fully opened or closed, a motor is fully started or stopped, or pressure within the system or a part of the system is substantially at zero p.s.i. (e.g. gauge) or other non-zero level before another change (e.g. valve opening or closing, motor start or stop) occurs (e.g. is initiated). In many cases a delay of between 100 and 300 milliseconds should be sufficient to allow a valve within multi-stage pump 100 to substantially fully open or close, however the actual delay to be utilized in a particular application or implementation of these techniques may be at least in part dependent on the viscosity of the fluid being utilized with multi-stage pump 100 along with a wide variety of other factors.

Figure 8A:
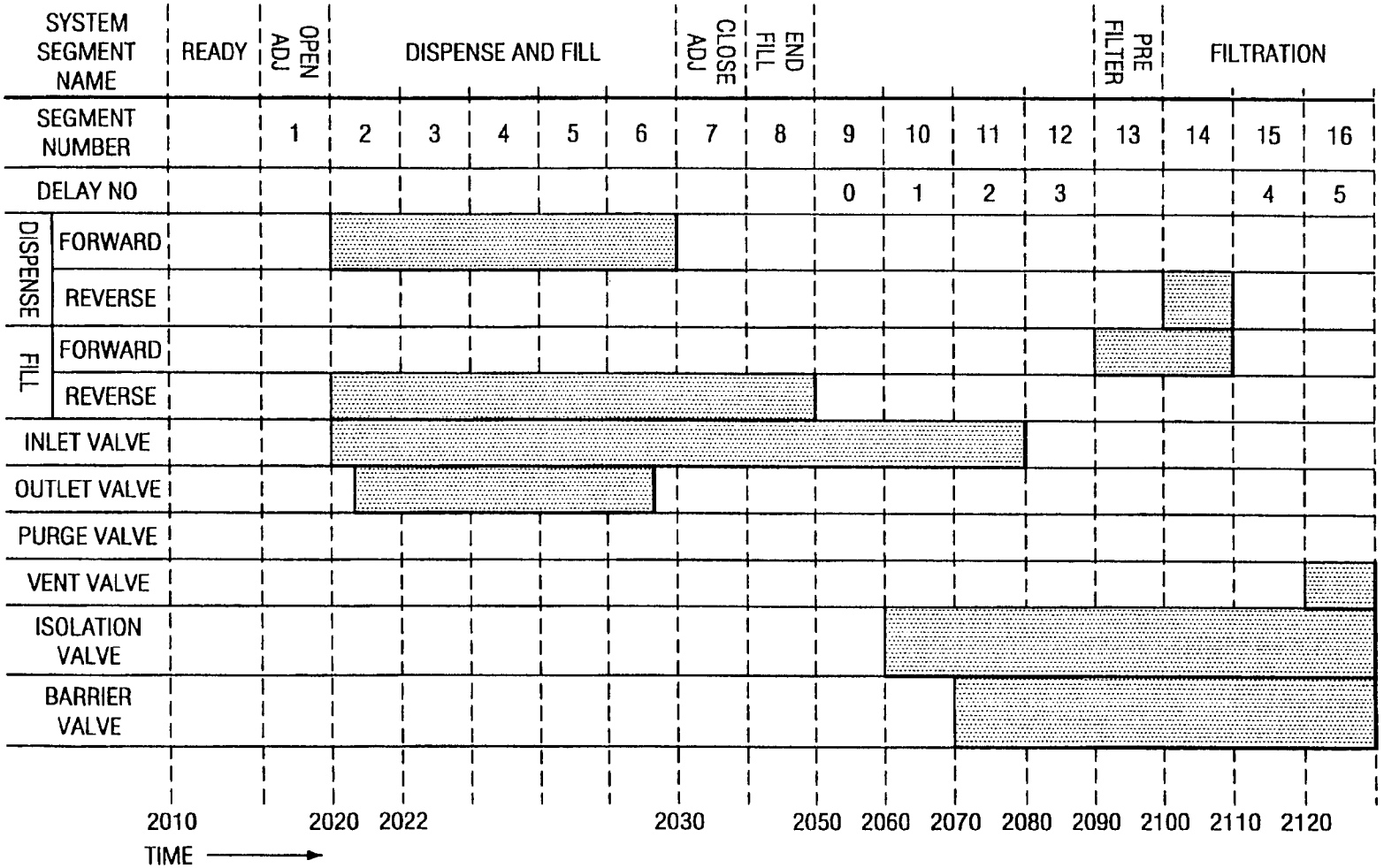
FIGS. 8A and 8B are diagrammatic representations of one embodiment of valve and motor timings for various segments of the operation of a pump.
Figure 8B:
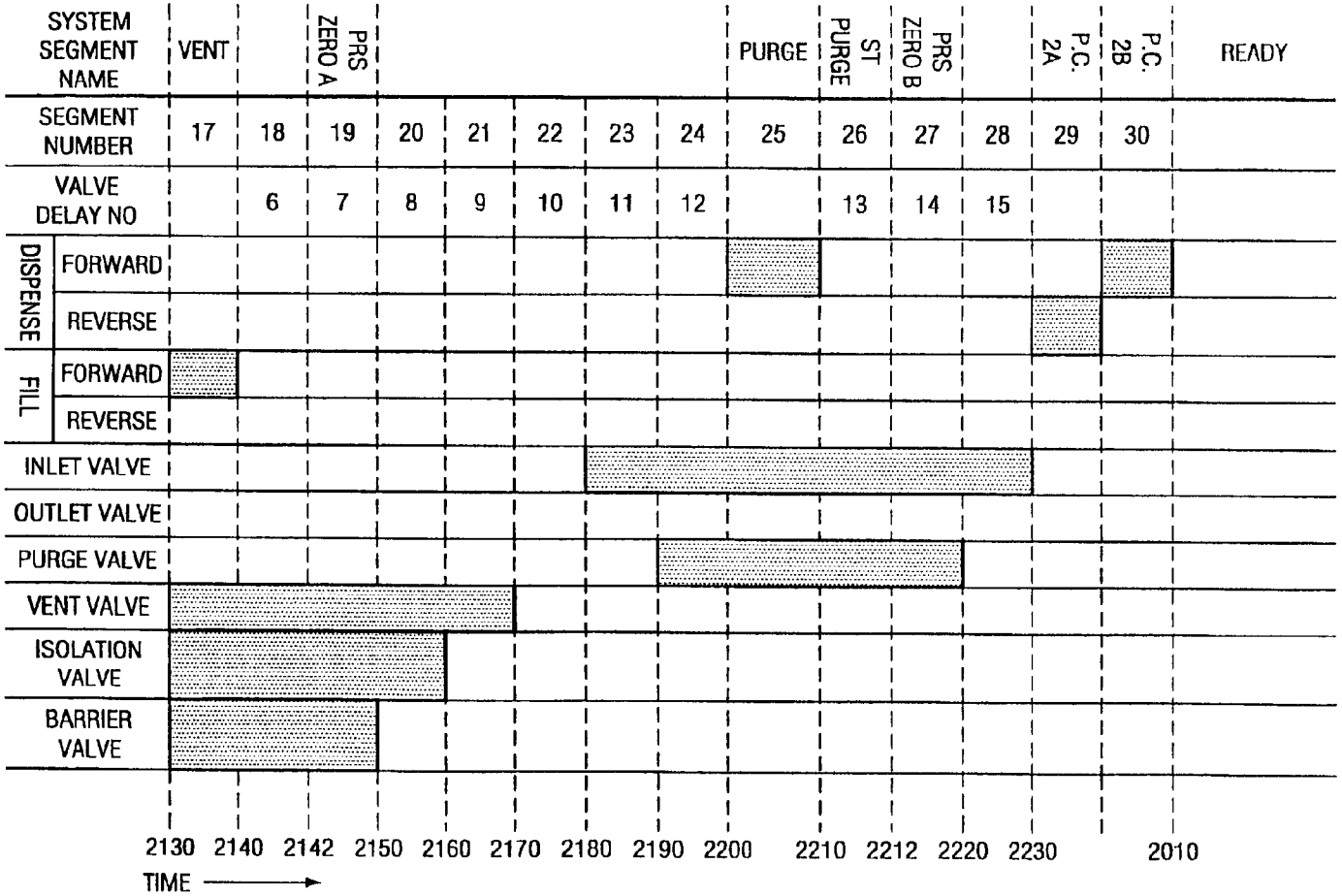

The above mentioned guidelines may be better understood with reference to FIGS. 8A and 8B which provide a diagrammatic representation of one embodiment of valve and motor timings for various segments of the operation of multi-stage pump 100 which serve to ameliorate pressure variations during operation of the multi-stage pump 100. It will be noted that FIGS. 8A and 8B are not drawn to scale and that each of the numbered segments may each be of different or unique lengths of time (including zero time), regardless of their depiction in these figures, and that the length of each of these numbered segments may be based on a wide variety of factors such as the user recipe being implemented, the type of valves being utilized in multi-stage pump 100 (e.g. how long it takes to open or close these valves), etc.

Referring to FIG. 8A, at time 2010 a ready segment signal may indicate that multi-stage pump 100 is ready to perform a dispense, sometime after which, at time 2010, one or more signals may be sent at time 2020 to open inlet valve 125, to operate dispense motor 200 in a forward direction to dispense fluid, and to reverse fill motor 175 to draw fluid into fill chamber 155. After time 2020 but before time 2022 (e.g. during segment 2) a signal may be sent to open outlet valve 147, such that fluid may be dispensed from outlet valve 147.

It will be apparent after reading this disclosure that the timing of the valve signals and motor signals may vary based on the time required to activate the various valves or motors of the pumps, the recipe being implemented in conjunction with multi-stage pump 100 or other factors. For example, in FIG. 8A, a signal may be sent to open outlet valve 147 after the signal is sent to operate dispense motor 200 in a forward direction because, in this example, outlet valve 147 may operate more quickly than dispense motor 200, and thus it is desired to time the opening of the outlet valve 147 and the activation of dispense motor 200 such that they substantially coincide to achieve a better dispense. Other valves and motors may, however, have different activation speeds, etc., and thus different timings may be utilized with these different valves and motors. For example, a signal to open outlet valve 147, may be sent earlier or substantially simultaneously with the signal to activate dispense motor 200 and similarly, a signal to close outlet valve 147 may be sent earlier, later or simultaneously with the signal to deactivate dispense motor 200, etc.

Thus, between time periods 2020 and 2030 fluid may be dispensed from multi-stage pump 200. Depending on the recipe being implemented by multi-stage pump 200 the rate of operation of dispense motor 200 may be variable between time periods 2020 and 2030 (e.g. in each of segments 2-6) such that differing amounts of fluid may be dispensed at different points between time periods 2020-2030. For example, dispense motor may operate according to a polynomial function such that dispense motor 200 operates more quickly during segment 2 than during segment 6 and commensurately more fluid is dispensed from multi-stage pump 200 in segment 2 than in segment 6. After the dispense segment has occurred, before time 2030 a signal is sent to close outlet valve 147 after which at time 2030 a signal is sent to stop dispense motor 200.

Similarly, between times 2020 and 2050 (e.g. segments 2-7) feed chamber 155 may be filled with fluid through the reversal of fill motor 175. At time 2050 then, a signal is then sent to stop fill motor 175, after which the fill segment is ended. To allow the pressure within fill chamber 155 to return substantially to zero p.s.i. (e.g. gauge), inlet valve may be left open between time 2050 and time 2060 (e.g. segment 9, delay 0) before any other action is taken. In one embodiment, this delay may be around 10 milliseconds. In another embodiment, the time period between time 2050 and time 2060 may be variable, and may depend on a pressure reading in fill chamber 155. For example, a pressure transducer may be utilized to measure the pressure in fill chamber 155. When the pressure transducer indicates that the pressure in fill chamber 155 has reached zero p.s.i. segment 10 may commence at time 2060.

At time 2060 then, a signal is sent to open isolation valve 130 and, after a suitable delay long enough to allow isolation valve 130 to completely open (e.g. around 250 milliseconds) a signal is sent to open barrier valve 135 at time 2070. Again following a suitable delay long enough to allow barrier valve 135 to completely open (e.g. around 250 milliseconds), a signal is sent to close inlet valve 125 at time 2080. After a suitable delay to allow inlet valve 125 to close completely (e.g. around 350 milliseconds), a signal may be sent to activate fill motor 175 at time 2090, and at time 2100 a signal may be sent to activate dispense motor 200 such that fill motor 175 is active during a pre-filter and filter segment (e.g. segments 13 and 14) and dispense motor 200 is active during the filter segment (e.g. segment 14). The time period between time 2090 and time 2100 may be a pre-filtration segment may be a set time period or a set distance for the movement or motor to allow the pressure of the fluid being filtered to reach a predetermined set point, or may be determined using a pressure transducer as described above.

Alternatively a pressure transducer may be utilized to measure the pressure of the fluid and when the pressure transducer indicates that the pressure of the fluid has reached a setpoint filter segment 14 may commence at time 2100. Embodiments of these processes are described more thoroughly in U.S. patent application Ser. No. 11/292,559, entitled "System and Method for Control of Fluid Pressure", by George Gonnella and James Cedrone, filed Dec. 2, 2005 and U.S. patent application Ser. No. 11/364,286 entitled "System and Method for Monitoring Operation of a Pump", by George Gonnella and James Cedrone which are hereby incorporated by reference.

After the filter segment, one or more signals are sent to deactivate fill motor 175 and dispense motor 200 at time 2110. The length between time 2100 and time 2110 (e.g. filter segment 14) may vary depending on the filtration rate desired, the speeds of fill motor 175 and dispense motor 200, the viscosity of the fluid, etc. In one embodiment, the filtration segment may end at time 2110 when dispense motor 200 reaches a home position.

After a suitable delay for allowing fill motor 175 and dispense motor 200 to completely halt, which may require no time at all (e.g. no delay), at time 2120 a signal is sent to open vent valve 145. Moving on to FIG. 8B, after a suitable delay to allow vent valve 145 to open completely (e.g. around 225 milliseconds), a signal may be sent to fill motor 175 at time 2130 to activate stepper motor 175 for the vent segment (e.g. segment 17). While barrier valve 135 may be left open during vent segment to allow monitoring of the pressure of fluid within multi-stage pump 100 by pressure transducer 112 during the vent segment, barrier valve 135 may also be closed prior to the beginning of the vent segment at time 2130.

To end the vent segment, a signal is sent at time 2140 to deactivate fill motor 175. If desired, between time 2140 and 2142 a delay (e.g. around 100 milliseconds) may be taken to allow the pressure of the fluid to suitably dissipate, for example, if the pressure of the fluid during the vent segment is high. The time period between time 2142 and 2150 may be used, in one embodiment, to zero pressure transducer 112 and may be around 10 milliseconds.

At time 2150, then, a signal is sent to close barrier valve 135. Following time 2150, a suitable delay is allowed such that barrier valve 135 can close completely (e.g. around 250 milliseconds). A signal is then sent at time 2160 to close isolation valve 130, and, after a suitable delay to allow isolation valve 130 to close completely (e.g. around 250 milliseconds), a signal is sent at time 2170 to close vent valve 145. A suitable delay is allowed so that vent valve 145 may close completely (e.g. around 250 milliseconds), after which, at time 2180 a signal is sent to open inlet valve 125, and following a suitable delay to allow inlet valve 125 to open completely (e.g. around 250 milliseconds), a signal is sent at time 2190 to open purge valve 140.

After a suitable delay to allow vent valve 145 to open completely (e.g. around 250 milliseconds), a signal can be sent to dispense motor 200 at time 2200 to start dispense motor 200 for the purge segment (e.g. segment 25) and, after a time period for the purge segment which may be recipe dependent, a signal can be sent at time 2210 to stop dispense motor 200 and end the purge segment. Between time 2210 and 2212 a sufficient time period (e.g. predetermined or determined using pressure transducer 112) is allowed such that the pressure in dispense chamber 185 may settle substantially to zero p.s.i (e.g. around 10 milliseconds). Subsequently, at time 2220 a signal may be sent to close purge valve 140 and, after allowing a sufficient delay for purge valve 140 to completely close (e.g. around 250 milliseconds), a signal may be sent at time 2230 to close inlet valve 125. After activating dispense motor 200 to correct for any pressure variations caused by closing of valves within multi-stage pump 100 (as discussed above) multi-stage pump 100 may be once again ready to perform a dispense at time 2010.

It should be noted that there may be some delay between the ready segment and the dispense segment. As barrier valve 135 and isolation valve 130 may be closed when multi-stage pump 100 enters a ready segment, it may be possible to introduce fluid into fill chamber 155 without effecting a subsequent dispense of multi-stage pump, irrespective of whether a dispense is initiated during this fill or subsequent to this fill.

Figure 9A:
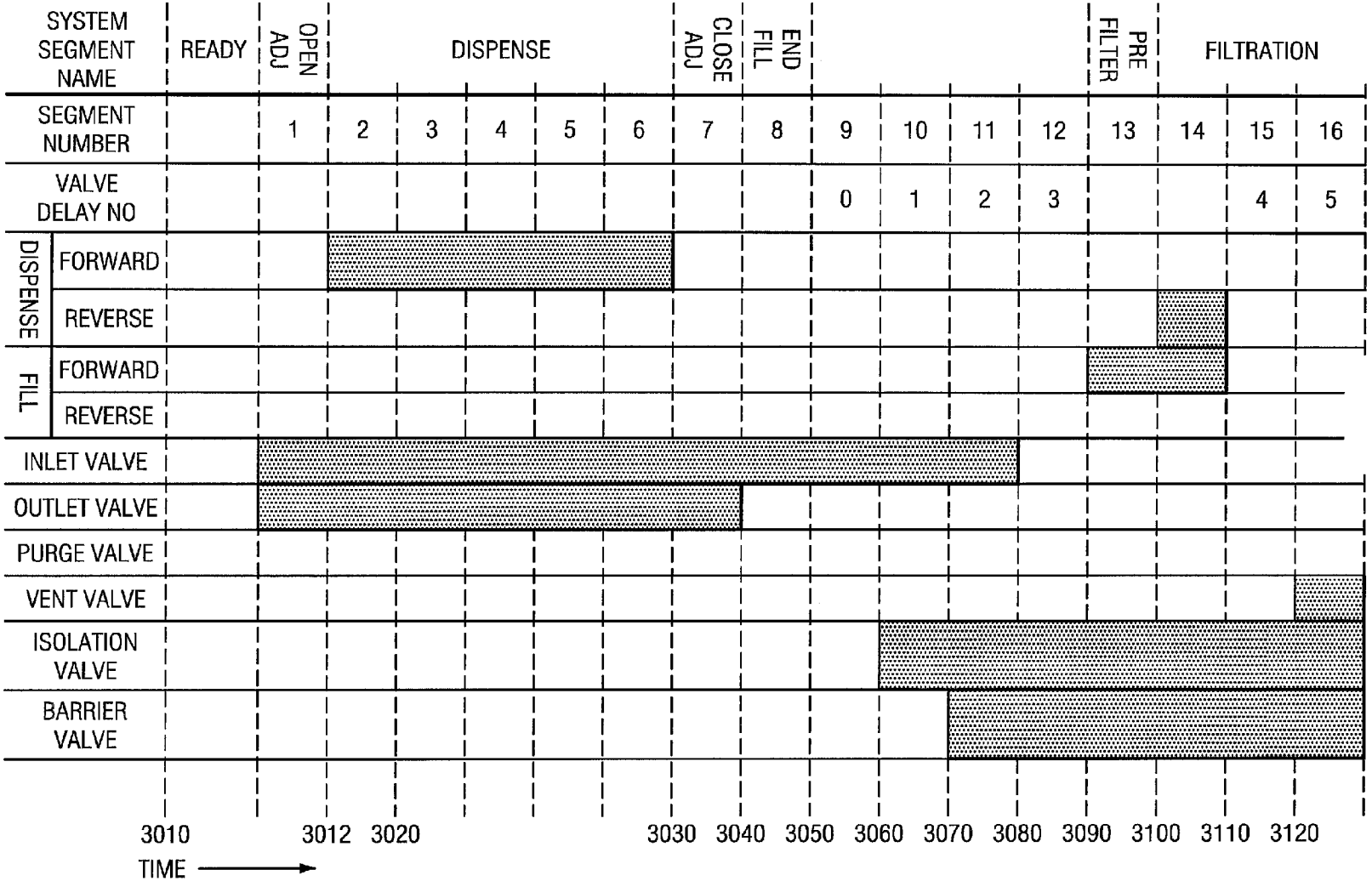
FIGS. 9A and 9B are diagrammatic representations of one embodiment of valve and motor timings for various segments of the operation of a pump.
Figure 9B:
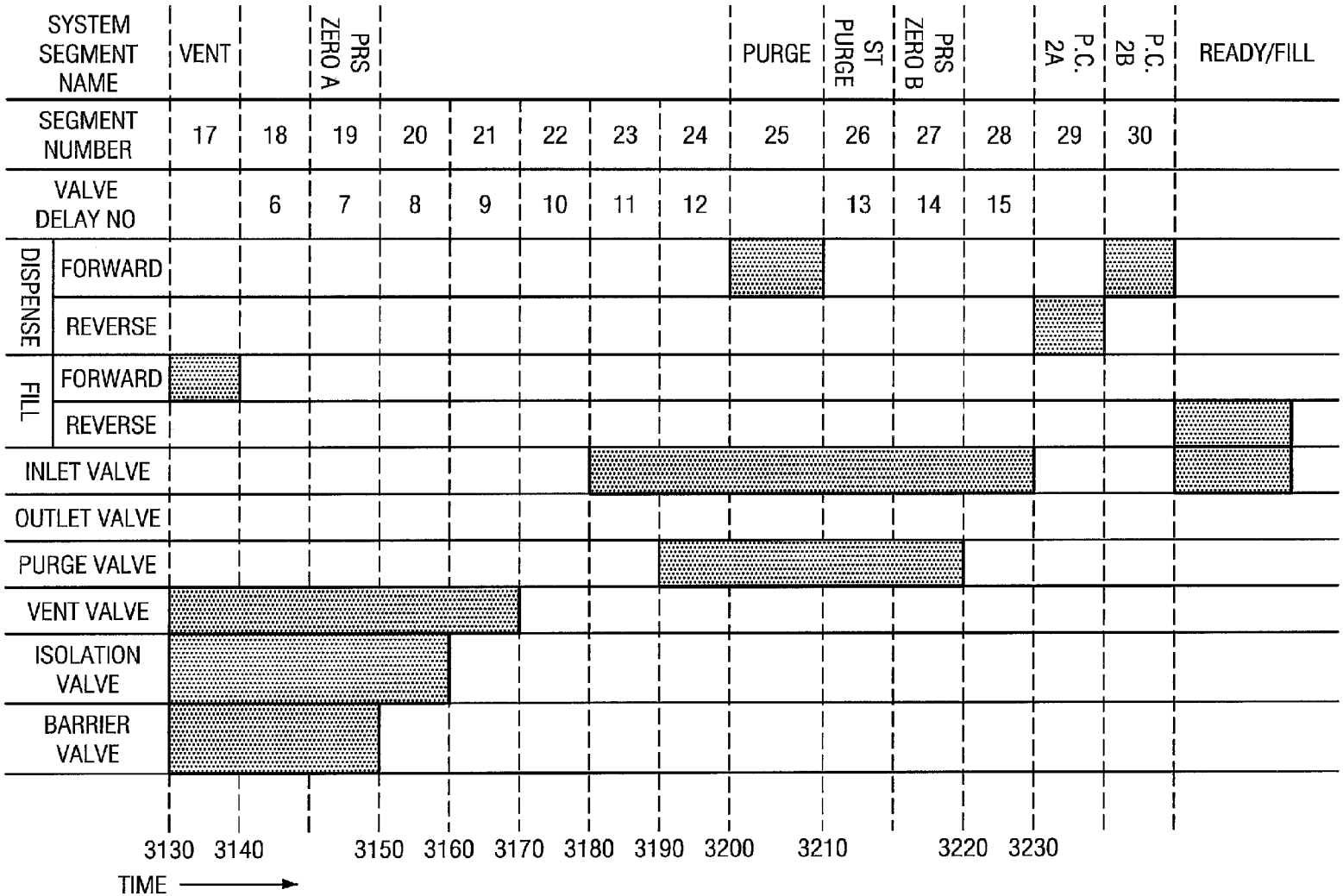

Filling fill chamber 155 while multi-stage pump 100 is in a ready state may be depicted more clearly with respect to FIGS. 9A and 9B which provide a diagrammatic representation of another embodiment of valve and motor timings for various segments of the operation of multi-stage pump 100 which serve to ameliorate pressure variations during operation of the multi-stage pump 100.

Referring to FIG. 9A, at time 3010 a ready segment signal may indicate that multi-stage pump 100 is ready to perform a dispense, sometime after which, at time 3012, a signal may be sent to open outlet valve 147. After a suitable delay to allow outlet valve 147 to open, one or more signals may be sent at time 3020, to operate dispense motor 200 in a forward direction to dispense fluid from outlet valve 147, and to reverse fill motor 175 to draw fluid into fill chamber 155 (inlet valve 125 may be still be open from a previous fill segment, as described more fully below). At time 3030 a signal may be sent to stop dispense motor 200 and at time 3040 a signal sent to close outlet valve 147.

It will be apparent after reading this disclosure that the timing of the valve signals and motor signals may vary based on the time required to activate the various valves or motors of the pumps, the recipe being implemented in conjunction with multi-stage pump 100 or other factors. For example (as depicted in FIG. 8A), a signal may be sent to open outlet valve 147 after the signal is sent to operate dispense motor 200 in a forward direction because, in this example, outlet valve 147 may operate more quickly than dispense motor 200, and thus it is desired to time the opening of the outlet valve 147 and the activation of dispense motor 200 such that they substantially coincide to achieve a better dispense. Other valves and motors may, however, have different activation speeds, etc., and thus different timings may be utilized with these different valves and motors. For example, a signal to open outlet valve 147, may be sent earlier or substantially simultaneously with the signal to activate dispense motor 200 and similarly, a signal to close outlet valve 147 may be sent earlier, later or simultaneously with the signal to deactivate dispense motor 200, etc.

Thus, between time periods 3020 and 3030 fluid may be dispensed from multi-stage pump 200. Depending on the recipe being implemented by multi-stage pump 200 the rate of operation of dispense motor 200 may be variable between time periods 3020 and 3030 (e.g. in each of segments 2-6) such that differing amounts of fluid may be dispensed at different points between time periods 3020-3030. For example, dispense motor may operate according to a polynomial function such that dispense motor 200 operates more quickly during segment 2 than during segment 6 and commensurately more fluid is dispensed from multi-stage pump 200 in segment 2 than in segment 6. After the dispense segment has occurred, before time 3030 a signal is sent to close outlet valve 147 after which at time 3030 a signal is sent to stop dispense motor 200.

Similarly, between times 3020 and 3050 (e.g. segments 2-7) feed chamber 155 may be filled with fluid through the reversal of fill motor 175. At time 3050 then, a signal is then sent to stop fill motor 175, after which the fill segment is ended. To allow the pressure within fill chamber 155 to return substantially to zero p.s.i. (e.g. gauge), inlet valve may be left open between time 3050 and time 3060 (e.g. segment 9, delay 0) before any other action is taken. In one embodiment, this delay may be around 10 milliseconds. In another embodiment, the time period between time 3050 and time 3060 may be variable, and may depend on a pressure reading in fill chamber 155. For example, a pressure transducer may be utilized to measure the pressure in fill chamber 155. When the pressure transducer indicates that the pressure in fill chamber 155 has reached zero p.s.i. segment 10 may commence at time 3060.

At time 3060 then, a signal is sent to open isolation valve 130 and a signal is sent to open barrier valve 135 at time 3070. A signal is then sent to close inlet valve 125 at time 3080 after which a signal may be sent to activate fill motor 175 at time 3090, and at time 3100 a signal may be sent to activate dispense motor 200 such that fill motor 175 is active during a pre-filter and filter segment and dispense motor 200 is active during the filter segment.

After the filter segment, one or more signals are sent to deactivate fill motor 175 and dispense motor 200 at time 3110. At time 3120 a signal is sent to open vent valve 145. Moving on to FIG. 9B, a signal may be sent to fill motor 175 at time 3130 to activate stepper motor 175 for the vent segment. To end the vent segment, a signal is sent at time 3140 to deactivate fill motor 175. At time 3150, then, a signal is sent to close barrier valve 125 while a signal is sent at time 3160 to close isolation valve 130 and at time 3170 to close vent valve 145.

At time 3180 a signal is sent to open inlet valve 125 and following that a signal is sent at time 3190 to open purge valve 140. A signal can then be sent to dispense motor 200 at time 3200 to start dispense motor 200 for the purge segment and, after the purge segment, a signal can be sent at time 3210 to stop dispense motor 200.

Subsequently, at time 3220 a signal may be sent to close purge valve 140 followed by a signal at time 3230 to close inlet valve 125. After activating dispense motor 200 to correct for any pressure variations caused by closing of valves within multi-stage pump 100 (as discussed above) multi-stage pump 100 may be once again ready to perform a dispense at time 3010.

Once multi-stage pump 100 enters a ready segment at time 3010, a signal may be sent to open inlet valve 125 and another signal sent to reverse fill motor 175 such that liquid is drawn into fill chamber 155 while multi-stage pump 100 is in the ready state. Though fill chamber 155 is being filled with liquid during a ready segment, this fill in no way effects the ability of multi-stage pump 100 to dispense fluid at any point subsequent to entering the ready segment, as barrier valve 135 and isolation valve 130 are closed, substantially separating fill chamber 155 from dispense chamber 185. Furthermore, if a dispense is initiated before the fill is complete, the fill may continue substantially simultaneously with the dispense of fluid from multi-stage pump 100.

When multi-stage pump 100 initially enters the ready segment the pressure in dispense chamber 185 may be at approximately the desired pressure for the dispense segment. However, as there may be some delay between entering the ready segment and the initiation of the dispense segment, the pressure within dispense chamber 185 may change during the ready segment based on a variety of factors such as the properties of dispense stage diaphragm 190 in dispense chamber 185, changes in temperature or assorted other factors. Consequently, when the dispense segment is initiated the pressure in dispense chamber 185 may have drifted a relatively marked degree from the baseline pressure desired for dispense.

Figure 10A:
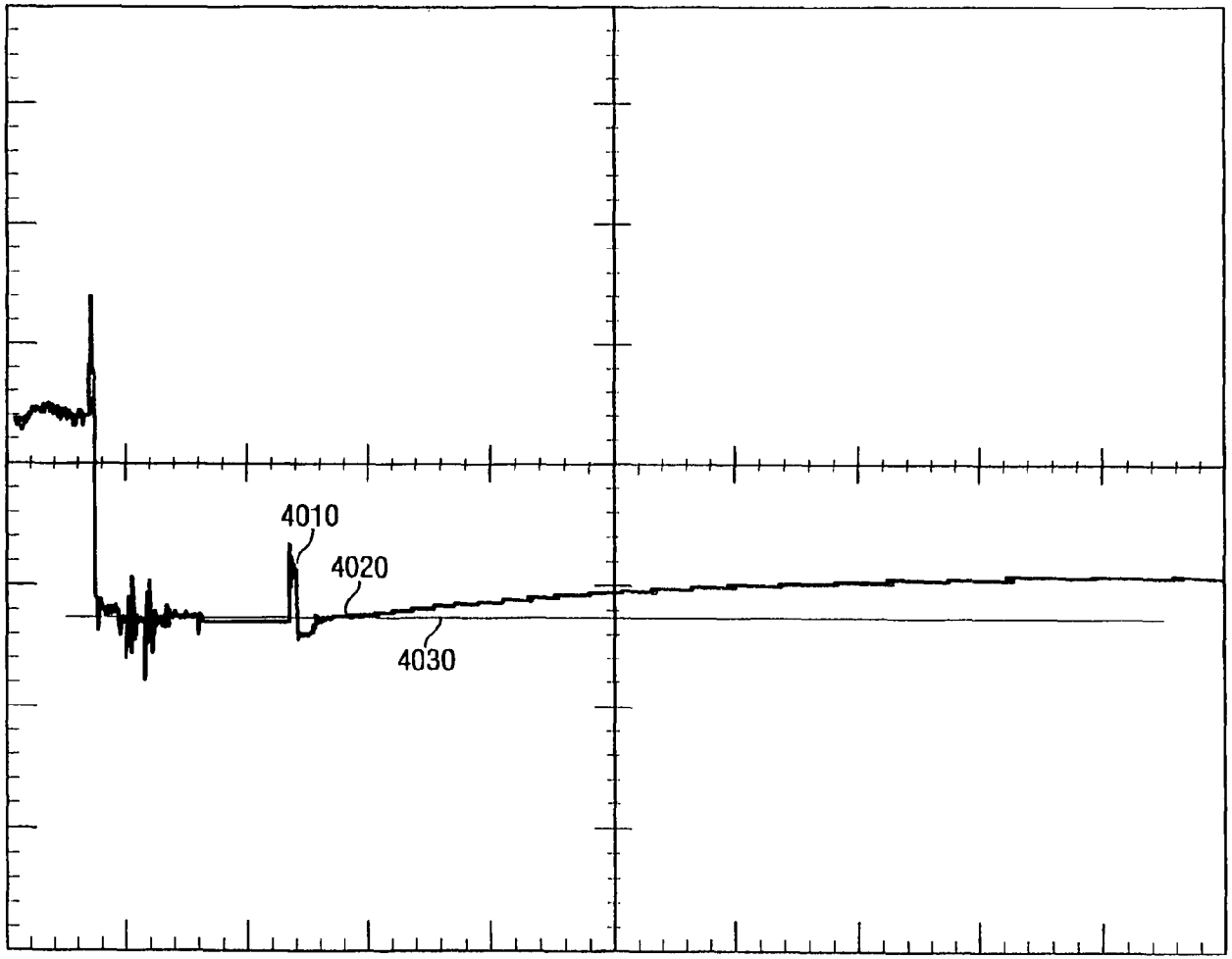
FIGS. 10A and 10B are example pressure profiles of a portion of an embodiment of an actuation sequence used with a pump.
Figure 10B:
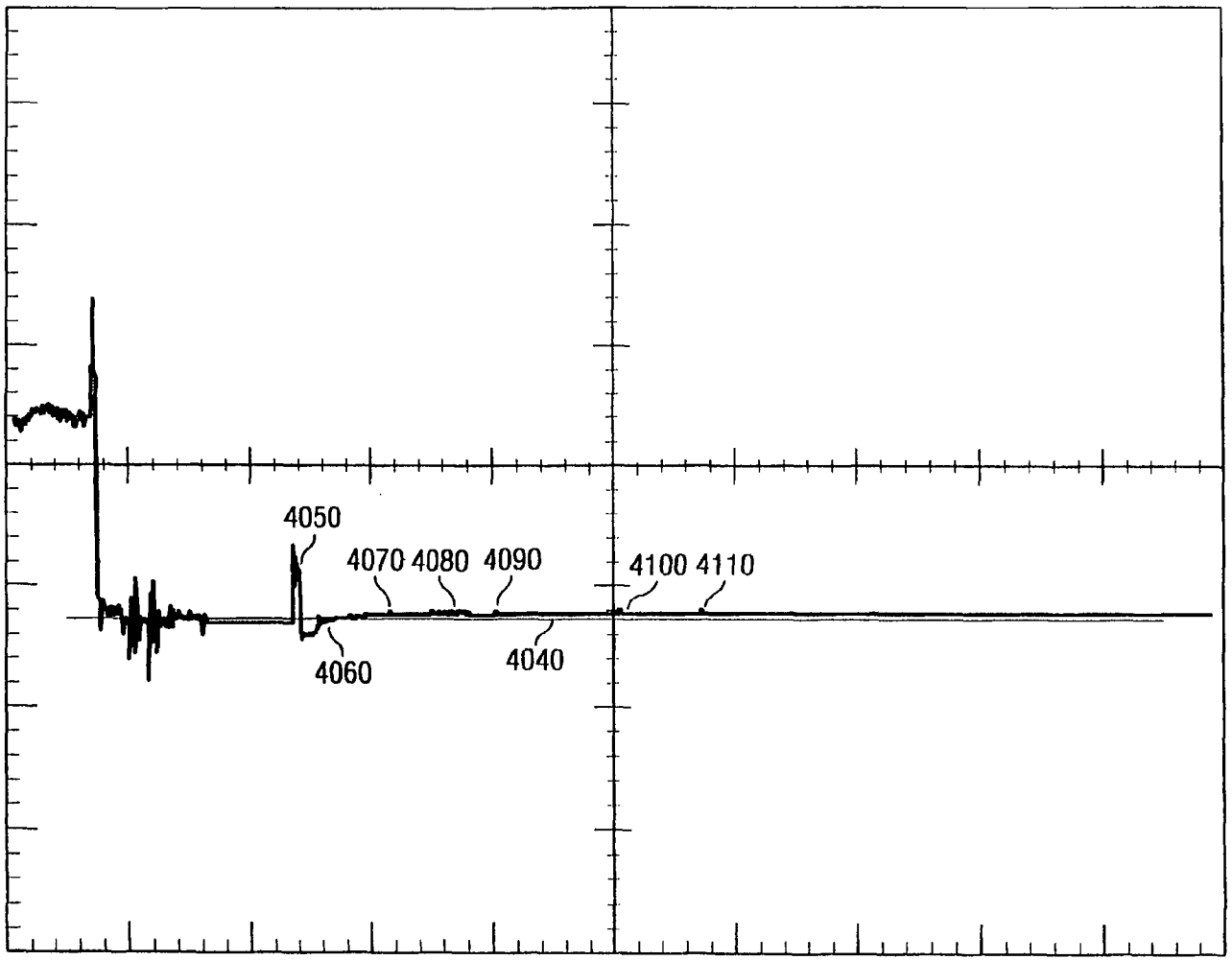

This drift may be demonstrated more clearly with reference to FIGS. 10A and 10B. FIG. 10A depicts an example pressure profile at dispense chamber 185 illustrating drift in the pressure in dispense chamber during a ready segment. At approximately point 4010 a correction for any pressure changes caused by valve movement or another cause may take place, as described above with respect to FIGS. 9A and 9B. This pressure correction may correct the pressure in dispense chamber 185 to approximately a baseline pressure (represented by line 4030) desired for dispense at approximately point 4020 at which point multi-stage pump 100 may enter a ready segment. As can be seen, after entering the ready segment at approximately point 4020 the pressure in dispense chamber 185 may undergo a steady rise due to various factors such as those discussed above. When a subsequent dispense segment occurs, then, this pressure drift from baseline pressure 4030 may result in an unsatisfactory dispense.

Additionally, as the time delay between entering a ready segment and a subsequent dispense segment may be variable, and the pressure drift in dispense chamber 185 may be correlated with the time of the delay, the dispenses occurring in each of successive dispense segments may be different due to the differing amounts of drift which may occur during the differing delays. Thus, this pressure drift may also affect the ability of multi-stage pump 100 to accurately repeat a dispense, which, in turn, may hamper the use of multi-stage pump 100 in process recipe duplication. Therefore, it may be desirable to substantially maintain a baseline pressure during a ready segment of multi-stage pump 100 to improve a dispense during a subsequent dispense segment and the repeatability of dispenses across dispense segments while simultaneously achieving acceptable fluid dynamics.

In one embodiment, to substantially maintain a baseline pressure during a ready segment dispense motor 200 can be controlled to compensate or account for an upward (or downward) pressure drift which may occur in dispense chamber 185. More particularly, dispense motor 200 may be controlled to substantially maintain a baseline pressure in dispense chamber 185 using a "dead band" closed loop pressure control. Returning briefly to FIG. 2, pressure sensor 112 may report a pressure reading to pump controller 20 at regular intervals. If the pressure reported deviates from a desired baseline pressure by a certain amount or tolerance, pump controller 20 may send a signal to dispense motor 200 to reverse (or move forward) by the smallest distance for which it is possible for dispense motor 200 to move that is detectable at pump controller 20 (a motor increment), thus backing out (or moving forward) piston 192 and dispense stage diaphragm 190 producing a commensurate reduction (or increase) in the pressure within dispense chamber 185.

As the frequency with which pressure sensor 112 may sample and report the pressure in dispense chamber 185 may be somewhat rapid in comparison with the speed of operation of dispense motor 200, pump controller 20 may not process pressure measurements reported by pressure sensor 112, or may disable pressure sensor 112, during a certain time window around sending a signal to dispense motor 200, such that dispense motor 200 may complete its movement before another pressure measurement is received or processed by pump controller 20. Alternatively, pump controller 20 may wait until it has detected that dispense motor 200 has completed its movement before processing pressure measurements reported by pressure sensor 112. In many embodiments, the sampling interval with which pressure sensor 112 samples the pressure in dispense chamber 185 and reports this pressure measurement may be around 30 khz, around 10 khz or another interval.

The above described embodiments are not without their problems, however. In some cases, one or more of these embodiments may exhibit significant variations in dispense when the time delay between entering a ready segment and a subsequent dispense segment is variable, as mentioned above. To a certain extent these problems may be reduced, and repeatability enhanced, by utilizing a fixed time interval between entering a ready segment and a subsequent dispense, however, this is not always feasible when implementing a particular process.

To substantially maintain the baseline pressure during a ready segment of multi-stage pump 100 while enhancing the repeatability of dispenses, in some embodiments dispense motor 200 can be controlled to compensate or account for pressure drift which may occur in dispense chamber 185 using closed loop pressure control. Pressure sensor 112 may report a pressure reading to pump controller 20 at regular intervals (as mentioned above, in some embodiments this interval may be around 30 khz, around 10 khz or at another interval). If the pressure reported is above (or below) a desired baseline pressure, pump controller 20 may send a signal to dispense motor 200 to reverse (or move forward) dispense motor 200 by a motor increment, thus backing out (or moving forward) piston 192 and dispense stage diaphragm 190 and reducing (or increasing) the pressure within dispense chamber 185. This pressure monitoring and correction may occur substantially continuously until initiation of a dispense segment. In this way approximately a desired baseline pressure may be maintained in dispense chamber 185.

As discussed above, the frequency with which pressure sensor 112 may sample and report the pressure in dispense chamber 185 may be somewhat frequent in comparison with the speed of operation of dispense motor 200. To account for this differential, pump controller 20 may not process pressure measurements reported by pressure sensor 112, or may disable pressure sensor 112, during a certain time window around sending a signal to dispense motor 200, such that dispense motor 200 may complete its movement before another pressure measurement is received or processed by pump controller 20. Alternatively, pump controller 20 may wait until it has detected, or received notice, that dispense motor 200 has completed its movement before processing pressure measurements reported by pressure sensor 112.

The beneficial effects of utilizing an embodiment of a closed loop control system to substantially maintain a baseline pressure as discussed can be readily seen with reference to FIG. 10B which depicts an example pressure profile at dispense chamber 185 where just such an embodiment of a closed loop control system is employed during a ready segment. At approximately point 4050 a correction for any pressure changes caused by valve movement or another cause may take place, as described above with respect to FIGS. 6 and 7. This pressure correction may correct the pressure in dispense chamber 185 to approximately a baseline pressure (represented by line 4040) desired for dispense at approximately point 4060 at which point multi-stage pump 100 may enter a ready segment. After entering the ready segment at approximately point 4060 an embodiment of a closed loop control system may account for any drift in pressure during the ready segment to substantially maintain a desired baseline temperature. For example, at point 4070 the closed loop control system may detect a pressure rise and account for this pressure rise to substantially maintain baseline pressure 4040. Similarly, at points 4080, 4090, 4100, 4110 the closed loop control system may account or correct for a pressure drift in dispense chamber 185 to substantially maintain the desired baseline pressure 4040, no matter the length of the ready segment (n.b. points 4080, 4090, 4100 and 4110 are representative only and other pressure corrections by the closed loop control system are depicted in FIG. 10B that are not given reference numerals and hence not discussed as such). Consequently, as the desired baseline pressure 4040 is substantially maintained in dispense chamber 185 by the closed loop control system during a ready segment, a more satisfactory dispense may be achieved in a subsequent dispense segment.

During the subsequent dispense segment, however, to achieve this more satisfactory dispense it may be desirable to account for any corrections made to substantially maintain the baseline pressure when actuating dispense motor 200 to dispense fluid from dispense chamber 185. More specifically, at point 4060 just after pressure correction occurs and multi-stage pump 100 initially enters a ready segment, dispense stage diaphragm 190 may be at an initial position. To achieve a desired dispense from this initial position, dispense stage diaphragm 190 should be moved to a dispense position. However, after correcting for pressure drift as described above, dispense stage diaphragm 190 may be in a second position differing from the initial position. In some embodiments, this difference should be accounted for during the dispense segment by moving dispense stage diaphragm 190 to the dispense position to achieve the desired dispense. In other words, to achieve a desired dispense, dispense stage diaphragm 190 may be moved from its second position after any correction for pressure drift during the ready segment has occurred, to the initial position of dispense stage diaphragm 190 when multi-stage pump 100 initially entered the ready segment, following which dispense stage diaphragm 190 may then be moved the distance from the initial position to the dispense position.

In one embodiment, when multi-stage pump 100 initially enters the ready segment pump controller 20 may calculate an initial distance (the dispense distance) to move dispense motor 200 to achieve a desired dispense. While multi-stage pump 100 is in the ready segment pump controller 20 may keep track of the distance dispense motor 200 has been moved to correct for any pressure drift that occurred during the ready segment (the correction distance). During the dispense stage, to achieve the desired dispense, pump controller 20 may signal dispense motor 200 to move the correction distance plus (or minus) the dispense distance.

In other cases, however, it may not be desirable to account for these pressure corrections when actuating dispense motor 200 to dispense fluid from dispense chamber 185. More specifically, at point 4060 just after pressure correction occurs and multi-stage pump 100 initially enters a ready segment, dispense stage diaphragm 190 may be at an initial position. To achieve a desired dispense from this initial position, dispense stage diaphragm 190 should be moved a dispense distance. After correcting for pressure drift as described above, dispense stage diaphragm 190 may be in a second position differing from the initial position. In some embodiments, just by moving dispense stage diaphragm 190 the dispense distance (starting from the second position) a desired dispense may be achieved.

In one embodiment, when multi-stage pump 100 initially enters the ready segment pump controller 20 may calculate an initial distance to move dispense motor 200 to achieve a desired dispense. During the dispense stage then, to achieve the desired dispense, pump controller 20 may signal dispense motor 200 to move this initial distance irrespective of the distance dispense motor 200 has moved to correct for pressure drift during the ready segment.

It will be apparent that the selection of one of the above described embodiments to be utilized or applied in any given circumstance will depend on a whole host of factors such as the systems, equipment or empirical conditions to be employed in conjunction with the selected embodiment among others. It will also be apparent that though the above embodiments of a control system for substantially maintaining a baseline pressure have been described with respect to accounting for an upward pressure drift during a ready segment, embodiments of these same systems and methods may be equally applicable to accounting for upward or downward pressure rift in a ready segment, or any other segment, of multi-stage pump 100. Furthermore, though embodiments of the invention have been described with respect to multi-stage pump 100 it will be appreciated that embodiments of these inventions (e.g. control methodologies, etc.) may apply equally well to, and be utilized effectively with, single stage, or virtually any other type of, pumping apparatuses.

Figure 11:
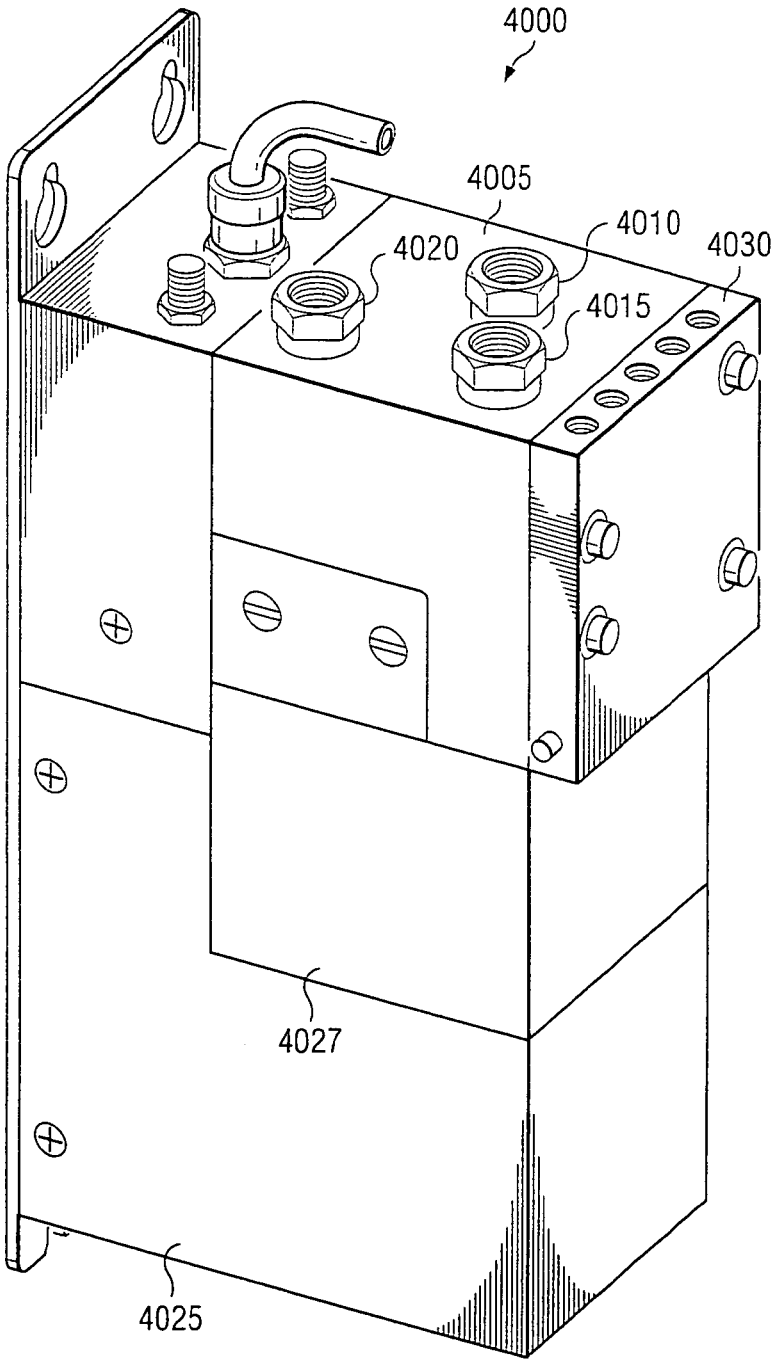
FIG. 11 is a diagrammatic representation of one embodiment of a pumping system.

It may be useful here to describe an example of just such a single stage pumping apparatus which may be utilized in conjunction with various embodiments of the present invention. FIG. 11 is a diagrammatic representation of one embodiment of a pump assembly for a pump 4000. Pump 4000 can be similar to one stage, say the dispense stage, of multi-stage pump 100 described above and can include a rolling diaphragm pump driven by a stepper, brushless DC or other motor. Pump 4000 can include a dispense block 4005 that defines various fluid flow paths through pump 4000 and at least partially defines a pump chamber. Dispense pump block 4005, according to one embodiment, can be a unitary block of PTFE, modified PTFE or other material. Because these materials do not react with or are minimally reactive with many process fluids, the use of these materials allows flow passages and the pump chamber to be machined directly into dispense block 4005 with a minimum of additional hardware. Dispense block 4005 consequently reduces the need for piping by providing an integrated fluid manifold.

Dispense block 4005 can include various external inlets and outlets including, for example, inlet 4010 through which the fluid is received, purge/vent outlet 4015 for purging/venting fluid, and dispense outlet 4020 through which fluid is dispensed during the dispense segment. Dispense block 4005, in the example of FIG. 11, includes the external purge outlet 4010 as the pump only has one chamber. U.S. Provisional Patent Application No. 60/741,660, entitled "O-Ring-Less Low Profile Fitting and Assembly Thereof" by Iraj Gashgaee, filed Dec. 2, 2005, and U.S. patent application Ser. No. 11/602,513 entitled "O-Ring-Less Low Profile Fittings and Fitting Assemblies" by Iraj Gashgaee, filed Nov. 20, 2006, which are hereby fully incorporated by reference herein, describes an embodiment of fittings that can be utilized to connect the external inlets and outlets of dispense block 4005 to fluid lines.

Dispense block 4005 routes fluid from the inlet to an inlet valve (e.g., at least partially defined by valve plate 4030), from the inlet valve to the pump chamber, from the pump chamber to a vent/purge valve and from the pump chamber to outlet 4020. A pump cover 4225 can protect a pump motor from damage, while piston housing 4027 can provide protection for a piston and, according to one embodiment of the present invention, be formed of polyethylene or other polymer. Valve plate 4030 provides a valve housing for a system of valves (e.g., an inlet valve, and a purge/vent valve) that can be configured to direct fluid flow to various components of pump 4000. Valve plate 4030 and the corresponding valves can be formed similarly to the manner described in conjunction with valve plate 230, discussed above. According to one embodiment, each of the inlet valve and the purge/vent valve is at least partially integrated into valve plate 4030 and is a diaphragm valve that is either opened or closed depending on whether pressure or vacuum is applied to the corresponding diaphragm. In other embodiments, some of the valves may be external to dispense block 4005 or arranged in additional valve plates. According to one embodiment, a sheet of PTFE is sandwiched between valve plate 4030 and dispense block 4005 to form the diaphragms of the various valves. Valve plate 4030 includes a valve control inlet (not shown) for each valve to apply pressure or vacuum to the corresponding diaphragm.

As with multi-stage pump 100, pump 4000 can include several features to prevent fluid drips from entering the area of multi-stage pump 100 housing electronics. The "drip proof" features can include protruding lips, sloped features, seals between components, offsets at metal/polymer interfaces and other features described above to isolate electronics from drips. The electronics and manifold can be configured similarly to the manner described above to reduce the effects of heat on fluid in the pump chamber. Thus, similar features as used in a multi-stage pump to reduce form factor and the effects of heat and to prevent fluid from entering the electronics housing can be used in a single stage pump.

Additionally, many of the control methodologies described above may also be used in conjunction with pump 4000 to achieve a substantially satisfactory dispense. For example, embodiments of the present invention may be used to control the valves of pump 4000 to insure that operate a system of valves of the pumping apparatus according to a valve sequence configured to substantially minimize the time the fluid flow path through the pumping apparatus is closed (e.g. to an area external to the pumping apparatus). Moreover, in certain embodiments, a sufficient amount of time will be utilized between valve state changes when pump 4000 is in operation to ensure that a particular valve is fully opened or closed before another change is initiated. For example, the movement of a motor of pump 4000 may be delayed a sufficient amount of time to ensure that the inlet valve of pump 4000 is fully open before a fill stage.

Similarly, embodiment of the systems and methods for compensate or account for a pressure drift which may occur in a chamber of a pumping apparatus may be applied with substantially equal efficacy to pump 4000. a dispense motor may be controlled to substantially maintain a baseline pressure in the dispense chamber before a dispense based on a pressure sensed in the dispense chamber a control loop may be utilized such that it is repeatedly determined if the pressure in the dispense chamber differs from a desired pressure (e.g. above or below) and, if so, the movement of the pumping means regulated to maintain substantially the desired pressure in the dispense chamber.

While the regulation of pressure in the chamber of pump 4000 may occur at virtually any time, it may be especially useful before a dispense segment is initiated. More particularly, when pump 4000 initially enters a ready segment the pressure in dispense chamber 185 may be at a baseline pressure which is approximately the desired pressure for a subsequent dispense segment (e.g. a dispense pressure determined from a calibration or previous dispenses) or some fraction thereof. This desired dispense pressure may be utilized to achieve a dispense with a desired set of characteristics, such as a desired flow rate, amount, etc. By bringing the fluid in dispense chamber 185 to this desired baseline pressure anytime before the outlet valve opens, the compliance and variations of components of pump 4000 may be accounted for prior to the dispense segment and a satisfactory dispense achieved.

As there may be some delay between entering the ready segment and the initiation of the dispense segment, however, the pressure within the chamber of pump 4000 may change during the ready segment based on a variety of factors. To combat this pressure draft, embodiments of the present invention may be utilized, such that a desired baseline pressure substantially maintained in the chamber of pump 4000 and a satisfactory dispense achieved in a subsequent dispense segment.

In addition to controlling for pressure drift in a single stage pump, embodiments of the present invention may also be used to compensate for pressure fluctuations in a dispense chamber caused by actuation of various mechanisms or components internal to pump 4000 or equipment used in conjunction with pump 4000.

One embodiment of the present invention may correct for a pressure change in the chamber of pump caused by the closing of a purge or vent valve before the start of a dispense segment (or any other segment). This compensation may be achieved similarly to that described above with respect to multi-stage pump 100, by reversing a motor of pump 4000 such that the volume of the chamber of pump 4000 is increase by substantially the hold-up volume of the purge or inlet valve whenever such a valve is closed.

Thus, embodiments of the present invention provide a pumping apparatuses with gentle fluid handling characteristics. By sequencing the opening and closing of valves and/or the activation of motors within a pumping apparatus, potentially damaging pressure spikes can be avoided or mitigated. Embodiments of the present invention can also employ other pump control mechanisms and valve linings to help reduce deleterious effects of pressure on a process fluid.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

What is claimed is:

1. A system, comprising:

a pumping apparatus comprising a chamber for receiving a fluid for dispense, a pump within the chamber and a sensor to sense a pressure in the chamber; and a controller configured to receive the pressure of the fluid in the chamber of the pumping apparatus from the sensor, determine if the pressure in the chamber is above a desired pressure, move the pump of the pumping apparatus to increase the volume of the chamber to compensate for a pressure increase if the pressure in the chamber is above the desired pressure, and send a signal to the pump to dispense fluid from the chamber, wherein the determination and movement are repeated to maintain substantially the desired pressure until the dispense of fluid is initiated.

2. The system of claim 1, wherein the desired pressure is a dispense pressure or a fraction of the dispense pressure.

3. The system of claim 1, wherein dispensing the fluid comprises moving the pump a dispense distance.

4. The system of claim 3, wherein the dispense distance is based on an initial position of the pump or a distance the pump is moved to maintain substantially the desired pressure.

5. The system of claim 3, wherein moving the pump comprises moving a piston of the pump by a motor increment.

6. The system of claim 1, wherein the controller is operable to disable the sensor during a time window such that the determination and movement are not repeated during the time window.

7. The system of claim 1, wherein the controller is operable to detect or receive notice that the pump has completed movement before repeating the determination and movement.

* * * * *